US012729053B2

(12) United States Patent
Bartolucci et al.

(10) Patent No.: US 12,729,053 B2
(45) Date of Patent: Sep. 8, 2026

(54) ERGONOMIC SQUEEZABLE PULP BOTTLE

(71) Applicant: The Procter & Gamble Company, Cincinnati, OH (US)

(72) Inventors: Stefano Bartolucci, Bad Homburg vor der Höhe (DE); Dennis James Minton, Geneva (CH); Susanne Will, Schwalbach am Taunus (DE); Kenneth Shun Qiang Ang, Singapore (SG); Sofie Van Assche, Oost-Vlaanderen (BE); Kelechukwu Nnabuike Onwukamike, Frankfurt am Main (DE); Michael Vincent Schlasinger, Cincinnati, OH (US); Geoffrey Allen King, London, OH (US); Pedro Vincent Vandecappelle, Wetteren (BE)

(73) Assignee: THE PROCTER & GAMBLE COMPANY, Cincinnati, OH (US)

( * ) Notice: Subject to any disclaimer, the term of this patent is extended or adjusted under 35 U.S.C. 154(b) by 120 days.

(21) Appl. No.: 18/912,646

(22) Filed: Oct. 11, 2024

(65) Prior Publication Data

US 2025/0122001 A1 Apr. 17, 2025

Related U.S. Application Data

(60) Provisional application No. 63/559,403, filed on Feb. 29, 2024, provisional application No. 63/589,372, filed on Oct. 11, 2023.

(51) Int. Cl.
*B65D 83/00* (2006.01)
*B65B 3/02* (2006.01)
(Continued)

(52) U.S. Cl.
CPC ..... *B65D 83/771* (2025.01); *B65B 3/02* (2013.01); *B65B 7/28* (2013.01); *B65B 43/10* (2013.01);
(Continued)

(58) Field of Classification Search
CPC ..... B65D 83/771; B65D 5/40; B65D 5/4266; B65D 47/2037; B65D 65/38;
(Continued)

(56) References Cited

U.S. PATENT DOCUMENTS 4,792,061 A * 12/1988 Nishida ..... B65D 35/12 222/107
5,736,204 A 4/1998 Suskind
(Continued)

FOREIGN PATENT DOCUMENTS

EP 4105139 A1 12/2022
GB 1399339 A 7/1975
(Continued)

OTHER PUBLICATIONS

16618MQ PCT Search Report and Written Opinion for PCT/US2024/050865 dated Feb. 6, 2025, 14 pages.
(Continued)

*Primary Examiner* — David J Walczak
(74) *Attorney, Agent, or Firm* — Matthew J Spegele; Jay A. Krebs

(57) ABSTRACT

A squeezable fiber-based bottle for storing and dispensing a viscous liquid. The bottle comprises a molded base including a liquid containing surface having an aperture for dispensing viscous liquid. The molded base includes a base perimeter having a perimeter surface with an upper edge and a lower edge. The squeezable fiber-based bottle comprises a fiber-based side wall having an upper edge, a lower edge, an inner surface, and an outer surface. The side wall includes a
(Continued)

front, a back and two opposing side panels. At least one of the opposing side panels includes crease lines forming a flat portion. The fiber-based side wall is attached to the molded base forming an impermeable seal such that the lower edge of fiber-based side wall is disposed near the perimeter surface upper edge but not the perimeter surface lower edge. The impermeable seal is formed about the entire perimeter surface of the molded base.

21 Claims, 18 Drawing Sheets

(51) Int. Cl.

| | |
|---|---|
| ***B65B 7/28*** | (2006.01) |
| ***B65B 43/10*** | (2006.01) |
| ***B65B 51/10*** | (2006.01) |
| ***B65D 5/40*** | (2006.01) |
| ***B65D 5/42*** | (2006.01) |
| ***B65D 47/20*** | (2006.01) |
| ***B65D 65/38*** | (2006.01) |

(52) U.S. Cl.
CPC ..... *B65B 51/10* (2013.01); *B65D 5/40* (2013.01); *B65D 5/4266* (2013.01); *B65D 47/2037* (2013.01); *B65D 65/38* (2013.01); *B65D 2565/385* (2013.01)

(58) Field of Classification Search
CPC .... B65D 2565/385; B65D 35/12; B65B 3/02; B65B 7/28; B65B 43/10; B65B 51/10; B29C 57/10
USPC ..... 222/213, 206, 212, 215; 401/183, 185, 401/186
See application file for complete search history.

(56) References Cited

U.S. PATENT DOCUMENTS

| | | | | |
|---|---|---|---|---|
| 5,736,567 | A | 4/1998 | Cantin et al. | |
| 7,052,752 | B2 | 5/2006 | Iwatsubo et al. | |
| 2010/0084361 | A1 | 4/2010 | Dayton et al. | |
| 2011/0259888 | A1* | 10/2011 | Kanderka ..... | B65D 5/029 53/484 |
| 2012/0305121 | A1 | 12/2012 | Sanchez | |
| 2022/0033158 | A1 | 2/2022 | Boswell et al. | |
| 2022/0034040 | A1 | 2/2022 | Boswell et al. | |
| 2022/0062141 | A1 | 3/2022 | Huang | |
| 2022/0112663 | A1 | 4/2022 | Boswell | |
| 2022/0112664 | A1 | 4/2022 | Boswell | |
| 2022/0267072 | A1 | 8/2022 | Moreno Brociner et al. | |
| 2025/0122672 | A1 | 4/2025 | Bartolucci et al. | |

FOREIGN PATENT DOCUMENTS

| | | | |
|---|---|---|---|
| WO | 2011034998 | A1 | 3/2011 |
| WO | 2020016409 | A1 | 1/2020 |
| WO | 2022107007 | A1 | 5/2022 |
| WO | 2022248403 | A1 | 12/2022 |

OTHER PUBLICATIONS

All Office Actions; U.S. Appl. No. 18/913,075, filed Oct. 11, 2024.

* cited by examiner

ERGONOMIC SQUEEZABLE PULP BOTTLE

FIELD OF THE INVENTION

An ergonomic squeezable fiber-based bottle for storing and on-demand dispensing viscous liquid product in wet environments. Preferably the squeezable fiber-based bottle is recyclable in the beverage carton stream.

BACKGROUND OF THE INVENTION

Since the era of industrialization, plastic products have been widely used in daily life. By virtue of quite low production costs and their versatility, plastic packaging materials have a higher rate of increase in the world market compared with other packaging materials. However, most of the plastics that we have on the market are made of virgin crude oil which is not a renewable source. Despite continuous improvement in the waste management infrastructure, plastic packaging sometimes doesn't get recycled after use and as a result, leak into the environment where it can be very persistent. Plastic pollution is causing both increased scrutiny by society in the use of plastics as well as an emergence of new environmental regulations limiting the use of plastics in packaging especially for applications with a short-life span.

Packaging made from natural cellulose fibers has become a point of increasing interest as part of a general movement towards inclusion of renewal and less persistent feedstock. Fiber based packaging generally also has a very high rate of recyclability. Cellulosic articles are generally formed as film or multi-ply boards using paper making processes or as 3D formed objects using pulp molding methods. While fibers can provide excellent structural support and a good decoration surface, paper sheets or formed objects alone cannot be used to pack liquid products due to their poor oxygen and moisture barrier and poor liquid containment properties leading to integrity failures. Thus, a protective coating is generally applied on the inner side after the cellulosic article is manufactured to extend the shelf life of the packaged liquid products.

Liquid packaging boards (LPB) are generally laminated with polymers with heat seal properties such as PE in a structure that can include one or more barrier layers such as EVOH, vacuum metalized aluminum oxide, etc. or alternatively coated with thin layer applied using a dispersion technique such as spray, roll, dip, blade or curtain coating. However, coatings bring trade-offs between barrier performance and package recyclability.

Boards can be formed to make packages such as cartons, cans or paper tubes using high-speed manufacturing processes. Paper cartons or cans can be suitable to dispense liquids that can be poured but have severe limitation to dispense viscous formulas such as those used in beauty and personal care. Current paper tubes have folded liquid packaging boards (LPB) including fiber for the side wall, but still require the use of a large amount of plastic due to the inclusion of plastic components needed to provide re-closability and dispensing control. Current paper tubes have also suboptimal ergonomics especially for large sizes due to a non-optimal grip. Paper tubes using commercially available folded fiber-based packaging boards have a generally stiffer wall than PBL (plastic barrier laminate) or extruded plastic tubes. This characteristic combined with the use of plastic closures mounted on shoulders limits the tube squeezability, collapsibility and thus the final product restitution. The use of thinner LPB gauges in current cosmetic tubes can improve squeezability/collapsibility, but also leads to sub-optimal dispensing as the paper laminate lacks the desired "shape" memory/bounce back necessary to provide dispensing control.

The grip and dispensing of bottles or tubes in a wet environment is also particularly challenging for consumers with disabilities or aging consumer e.g., impacted by arthritis especially since the package surface can be slippery. Also, the hygroscopicity nature of fibers presents additional challenges for fiber-based packaging applications used in damp or wet environments such as in-shower or bathroom use.

Liquid packaging boards typically contain relatively high amount of sizing agents such alkyl ketene dimers (AKD) to increase the hygroscopicity but suffers failures from in-plane edge wicking typically induced by liquid sorption into cut raw edges by capillary action. Such liquid sorption results in delamination and exposure of unsized fiber-fiber bonds and/or weakening of bonds between layers resulting in separation of multi-ply surfaces.

Maximizing the inclusion of bio-based fibers in the package is desired to improve the bio-based renewable content and recovery in re-processing the fibers. Maximizing the inclusion of bio-based fibers in the package is also desired to maximize the ergonomics during dispensing especially in a wet environment. Increasing fiber inclusion is also desired to enable a product restitution above 90% (or even above 95%) and flatten the bottle at disposal, which is beneficial for sorting and circular economy. Fiber-based bottles are desired that minimize plastic inclusion as well as provide unique design shapes, deliver a reasonable shelf life of at least 6 months to 2 years, in-shower survival, inclusivity usage and recyclability. Preferably, squeezable fiber-based bottles are desired for use in wet environments, capable of maintaining integrity while containing liquid formulas, enabling on-demand dispensing, superior in-use ergonomics, exhibiting a reasonable shelf-life, and optimized for recycling and disposal.

SUMMARY OF THE INVENTION

The present disclosure provides a squeezable fiber-based bottle for storing and dispensing a viscous liquid. The bottle comprises a molded base including a liquid containing surface having an aperture for dispensing viscous liquid. The molded base includes a base perimeter having a perimeter surface with an upper edge and a lower edge. The squeezable fiber-based bottle comprises a fiber-based side wall having an upper edge, a lower edge, an inner surface, and an outer surface. The fiber-based side wall includes a front, a back and at two opposing side panels. At least one of the two opposing side panels includes crease lines forming a flat portion. The inner surface of the fiber-based side wall includes a fiber-based side wall barrier layer having a WVTR of less than 20 g/sqm/day at 25° C., 60% relative humidity. The lower edge of the fiber-based side wall is attached to the molded base forming an impermeable seal. The impermeable seal is formed about the entire perimeter surface of the molded base wherein the lower edge of the fiber-based side wall is near the perimeter surface upper edge but not the perimeter surface lower edge, The perimeter surface of the molded base can include a lip or ledge to accommodate the lower edge of the fiber-based side wall. Alternatively, the fiber-based side wall can wrap around the lower edge of the molded base so that the lower edge of the fiber-based sidewall is disposed on an inner perimeter surface near the perimeter surface upper edge but not the perimeter surface lower edge. The molded base perimeter surface lower edge is below the liquid containing surface allowing the squeezable fiber-based bottle to stand vertically. The aperture for dispensing viscous fluid includes a slit valve formed of plastic or other resin material.

BRIEF DESCRIPTION OF THE DRAWINGS

While the specification concludes with claims particularly pointing out and distinctly claiming the subject matter which is regarded as forming the present invention, it is believed that illustrative embodiments of the present invention may be better understood from the following description taken in conjunction with the accompanying drawings, in which:

DETAILED DESCRIPTION OF THE INVENTION

Figure 1:
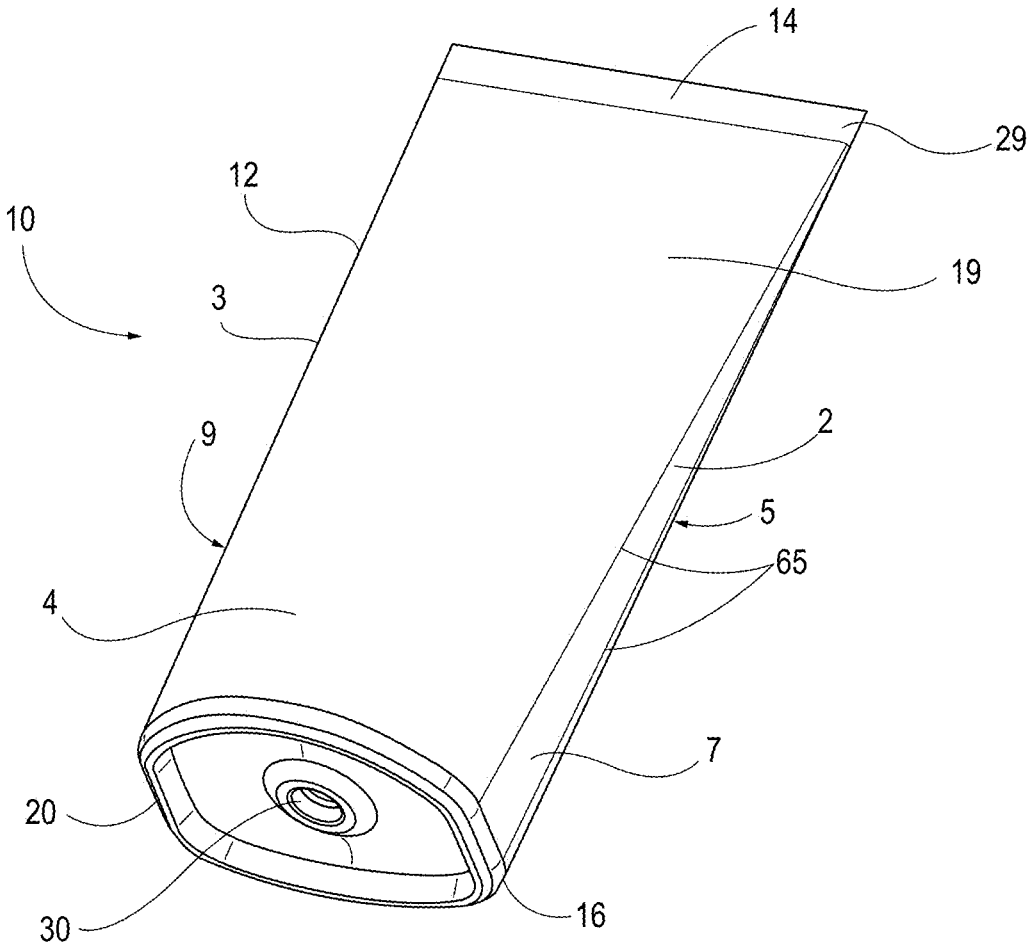
FIG. 1 is a perspective view of a squeezable fiber-based bottle according to the present disclosure.

The present invention may be understood more readily by reference to the following detailed description of illustrative and preferred embodiments. It is to be understood that the scope of the claims is not limited to the specific components, methods, conditions, devices, or parameters described herein, and that the terminology used herein is not intended to be limiting of the claimed invention. Also, as used in the specification, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent basis "about," it will be understood that the particular values form another embodiment. All ranges are inclusive and combinable.

An objective of this invention is to provide a squeezable fiber-based bottle for a liquid composition including at least more than 50% fiber content, repulpable in the paper/cardboard recycling stream (including the used beverage carton recycling stream), providing both superior ergonomics and dispensing, enabling greater than 90% product evacuation, able to be flattened when disposed, enabling high volume packing efficiency and able to survive distribution, storage and use in a wet environment.

Another objective is to provide a method of forming a squeezable fiber-based container. The method comprises the steps of cutting a piece of planar elongated blank from a liquid packaging board sheet or web. The blank has a first side edge, a second side edge, a lower edge and an upper edge. The blank is creased forming lines directionally extending from the lower edge to the upper edge of the blank. The blank is secured to a fixture corresponding to the shape of the bottle to be manufactured. The blank is folded around the fixture so that the first side edge and the second side edge overlap forming monolithic bottle shape with two open ends. Heat-sealing energy and pressure are applied to the overlapped side edges forming a hermetically sealed seam. The fixture is removed from inside the container, and the lower edge of the fiber-based side wall is attached to a molded base forming an impermeable seal. The molded base has a perimeter surface upper edge and a perimeter surface lower edge. The lower edge of the fiber-based side wall is disposed near the perimeter surface upper edge but not the perimeter surface lower edge. The bottle is filled, and the upper edge is sealed.

Another objective of this invention is to provide a squeezable bottle with scores to tear open the bottle, access the residual content and wash the bottle interior from residuals before disposal.

"Pulp" is preferably defined as a fibrous material produced by mechanically or chemically separating fibers from sustainable sources and then suspended in a fluid.

"Fiber" is preferably defined as a natural substance of wood or vegetable origin that is significantly longer than it is wide.

"Molded base" is preferably defined as a component made either in plastic, using either injection molding or compression molding or thermoforming or in fibers, using either pulp molding or liquid-carton-board forming.

"Impermeable seal" is preferably defined as an area between two or more mating surfaces or objects that is impervious to liquids. This can include every fluid tight connection to prevent leakage of the product inside the bottle as well as means of protecting the paper/cardboard raw edge.

FIG. 1, an exemplary squeezable fiber-based bottle 10 is shown. The squeezable fiber-based bottle 10 includes a fiber-based side wall 12 and a molded base 20. The fiber-based side wall 12 includes an upper edge 14, a lower edge 16 attached to the molded base 20, a front panel 4, a back panel 5, two opposing side panels 2, 3, an outside surface 19 and an inner surface (not shown). The inner surface of fiber-based side wall includes a liquid containment material (not shown). The fiber-based side wall 12 can include a liquid carton board comprising a multi-layer sheet with a multi-ply baseboard and one or more functional layers. The side wall 12 includes creases 65 in the two opposing side panels 2, 3 extending from the lower edge 16 at the base 20 to the upper edge 14. The creases 65 create sustainable flat portions 7 and 9 in the two opposing side panels 2, 3 creating flat portion 7 and flat portion 9, respectfully. The molded base 20 includes an aperture 30 for dispensing viscous liquid contained in the squeezable fiber-based bottle 10. The two opposing side panels 2, 3 include a flat side portion 7 and a flat side portion 9.

Cosmetic paper tubes in the prior art include uncreased liquid packaging boards (LPB) in the side wall of higher modulus and bending stiffness compared to plastic laminates i.e., wherein the LPB is bent into a cylinder and formed into a single curved surface. The stiffer side wall combined with the stiff tube structure enable the cylindrical side wall section to act as a tubular spring limiting the dose dispensed when an acceptable squeezing force is exerted. For example, squeezing a filled commercially available paper tube of 50 mm in diameter with a 10 mm displacement produces a dose of about 1.6 g for a 30N squeezing force. It has been determined that consumers generally exert a 20-30 N squeezing force on a tube and that such squeezing force rarely exceeds 50N. Since a typical desired dosage for most personal care applications is 5-10 g, consumers resolve to inconveniently squeezing the tube multiple times or exerting a very large squeezing pressure resulting in denting the tube and an undesired permanent deformation.

Creasing according to the present disclosure, enables folding the LPB to form sharp edges. The sharp edges result in a discontinuity in the curvature of the side wall surface creating flat portions that are easier to squeeze when deflected than a round or oval tube having the same inner volume and side wall material. This enables a higher dosage per squeeze than prior art cosmetic paper tubes at similar squeezing force. Further, it was found that flat portions 7, 9 on the opposing side panels 2, 3 promote a "spring back" of the squeezed side panels since the creases 65 act as living hinges preventing denting and permanent deformation when the squeezing pressure is released. In addition, the creases enable the opposing side panels to collapse in a flat configuration providing a product restitution greater than 90% and tube disposal when a force of at least 45N is applied to crush the side panels.

The substrate of the liquid carton board forming the fiber-based side wall 12 preferably contains lignocellulosic fibers obtained by any conventional pulping process, including bleached or unbleached chemical, mechanical, chemi-mechanical pulping processes. The carton board can be made from more than one ply, typically 3 plies, and is usually in the form of a fibrous web.

Preferably the carton board has a grammage from 170-430 gsm and more preferably about 250 to 350 gsm. Preferably the functional layers can be on both the inner surface forming the liquid containment portion and the outer surface 19. The most inner and most outer layers are preferably low-density polyethylene (LDPE) layers to ensure good sealing and liquid tightness. The LDPE in the most outer layer also ensures protection from moisture pick-up from splash or wet handling. The LDPE also ensures that after consumer disposal and household collection the NIR detector in industrial sorting facilities can positively identify the bottle and divert the package to the used beverage carton recycling stream where multi-material packages are effectively recycled and the fiber regained for future use.

For example, the liquid carton board may be a multilayer structure comprising one or more layers made of bleached sulphate pulp. The liquid carton board may comprise a top layer made of bleached sulphate pulp, a middle layer made of chemi-thermomechanical pulp CTMP, a back layer made of bleached sulphate pulp and a polyethylene PE layer on the outer surface of the top layer and/or the back layer. The liquid carton board used can be products of the Finnish company Stora Enso marketed with trademarks Natura™ 2PE Board or Natura™ Barr. Natura™ 2PE Board is a bleached liquid packaging board with a three-layer fiber construction, with two outer layers made of bleached sulphate pulp and a middle layer made of CTMP (chemi-thermo-mechanical pulp). Its top and reverse sides are polyethylene PE coated with no inclusion of any additional high barrier coating. Natura™ Barr is a bleached liquid packaging board with a three-layer fiber construction, with two outer layers made of bleached sulphate pulp and a middle layer made of CTMP (chemi-thermo-mechanical pulp). It has a polyethylene PE coating on the top side and a multilayer high-barrier coating on the reverse side. The functional layer can include barrier layers such as high density polyethylene (HDPE), a foil, or a thin coating from metallization, applications of cellulose fibers or water dispersible nanocomposites including nanoplatelets. Alternatively, both the inner and outer coating can be a polymeric water dispersion, such as BASF Joncryl or Down Rhobarr 1. The water dispersions can be applied by a variety of techniques such as dip, rod, doctor blade, knife, gravure, reverse roll, air knife, and forward roll or spray followed by a drying step. An example of carton boards using water-based dispersion coatings are Cupforma Natura Aqua+ commercialized by Stora Enso and ISLA commercialized by Kotkamills.

Figure 2:
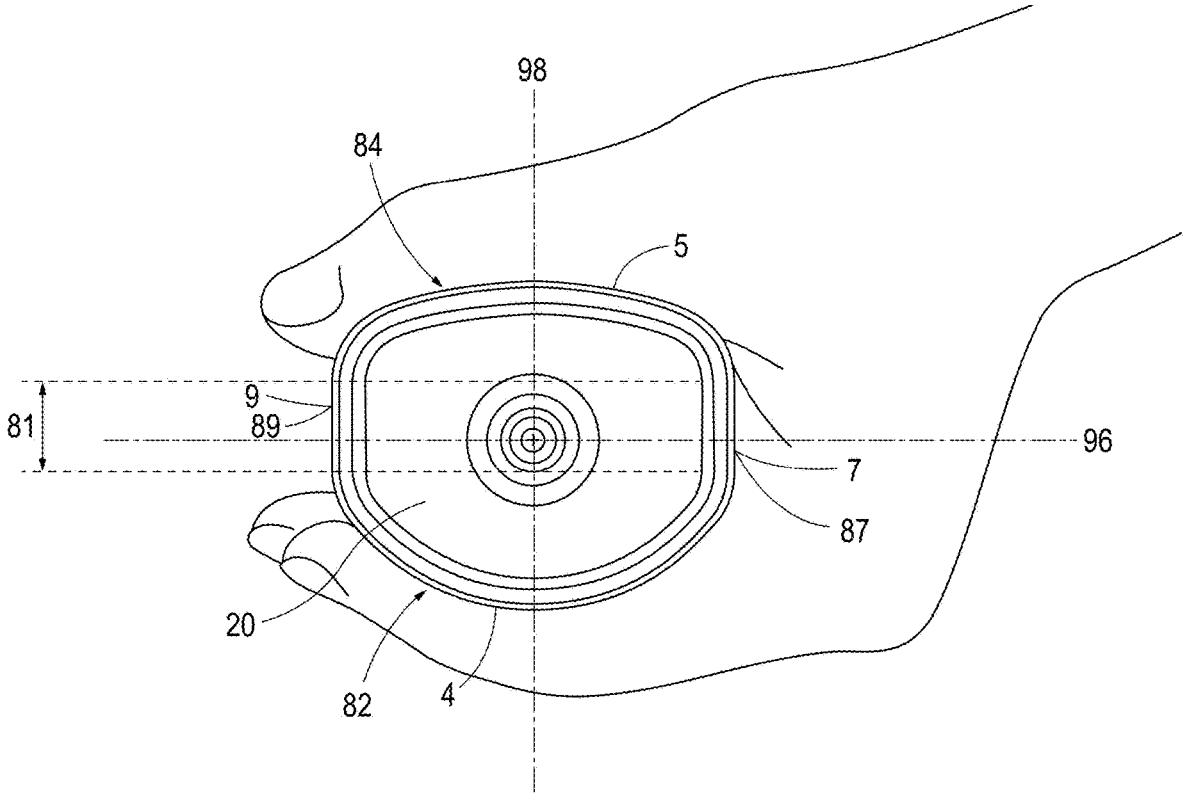
FIG. 2 is a bottom view of the bottle shown in FIG. 1 showing the bottle in use.

FIG. 2 shows a bottom view of the exemplary squeezable fiber-based bottle 10 as being gripped by a user during dispensing. As shown, the thumb presses against the back panel 5 while the other fingers press against the front panel 4. The flat side portion 7 of the bottle 10 interlocks the metacarpal region of the palm. Surprisingly this configuration was found to enable most users (95 percent adult male and female population) to achieve a good grip and maximize the squeezing force without relying on high surface friction. This is preferably desired when the bottle 10 is used in a wet environment. As shown in FIG. 2, the molded base 20 has a major axis 96 corresponding to the length of the molded base 20 and a minor axis 98 corresponding to the width of the molded base 20. Preferably, the maximum length of the molded base 20 is larger than the maximum width. In a preferred embodiment, the maximum width of the molded base 20 is 66 mm. The back panel 5 and front panel 4 of the bottle 10 have curvatures corresponding to the perimeter surface of the upper edge of the molded base 20 that the lower edge 16 of the side panel 12 is attached. The curvature of the molded base 20 back surface 84 can be higher than the curvature of the front surface 82. Similarly, flat portions 7 and 9 in the two opposing side panels 2 and 3, correspond to flat surfaces 87, 89 on opposing sides of the molded base 20. The length 81 of the flat surfaces 87 and 89 on opposing sides of the molded base 20 are less than the maximum width of the molded base 20. Preferably, the maximum width of the molded base 20 exceeds the length 81 of the flat surfaces 87 and 89 on the molded base 20 by less than 10 mm. This configuration is beneficial to optimize the footprint volumetric efficiency of the bottle while maintaining an acceptable squeezing performance.

Figures 3A, 3B, 3C:
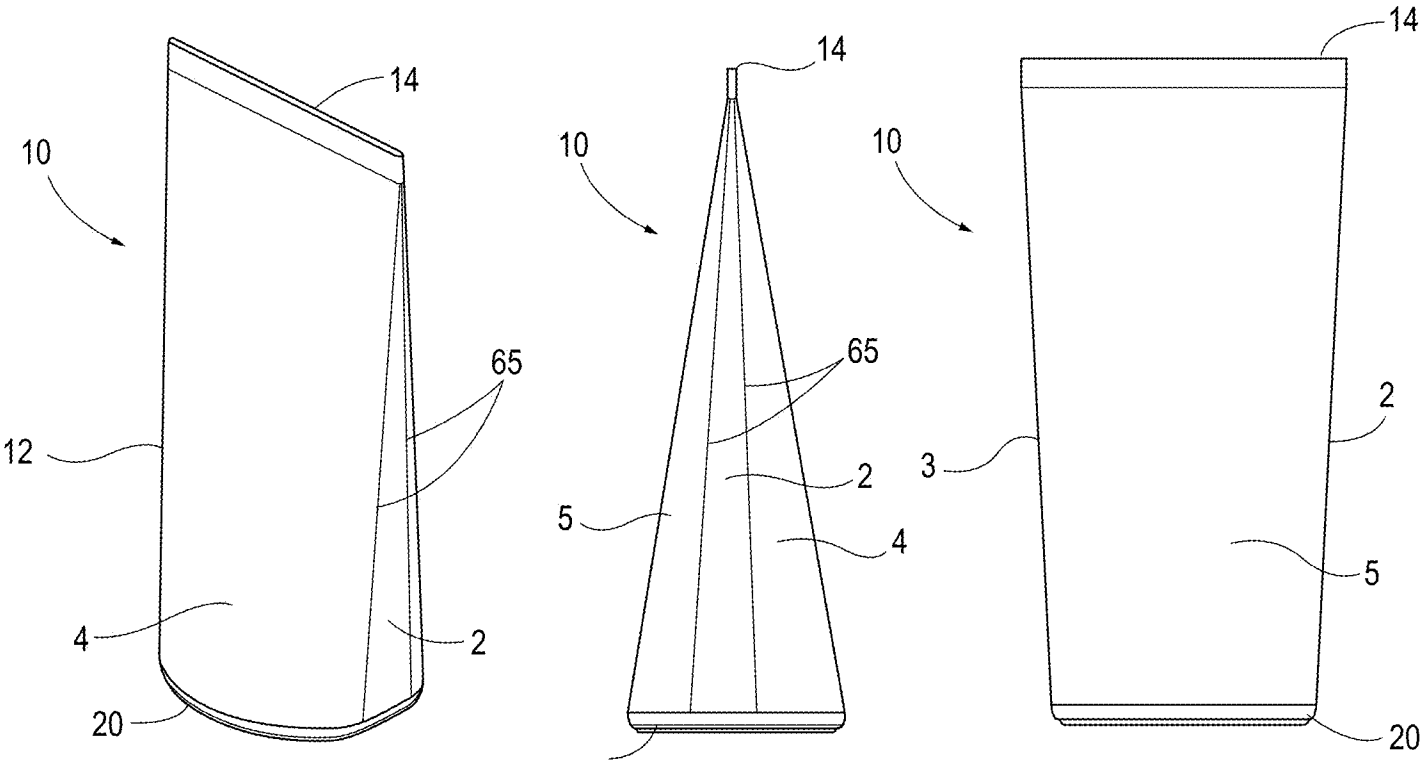
FIG. 3*a* is a perspective view of a squeezable fiber-based bottle according to the present disclosure.
FIG. 3*b* is a side view of the squeezable fiber-based bottle shown in FIG. 3*a*.
FIG. 3*c* is a front view of the squeezable fiber-based bottle shown in FIG. 3*a*.

FIG. 3*a* shows an isometric view and FIG. 3*b* shows a side view of a squeezable fiber-based bottle 10 according to the disclosure wherein the side wall 12 includes one or more creases 65 on the two opposing side panels 2, 3. Besides improving the grip as previously described, the creases 65 were found to aid with enhancing the collapsibility of the bottle 10 into a flat configuration as shown in FIG. 3*c* illustrating the back panel 5 of the squeezable fiber-based bottle 10. This is particularly helpful to maximize product evacuation as well as enhance flattening of the squeezable fiber-based bottle 10 before disposal.

Figure 4:
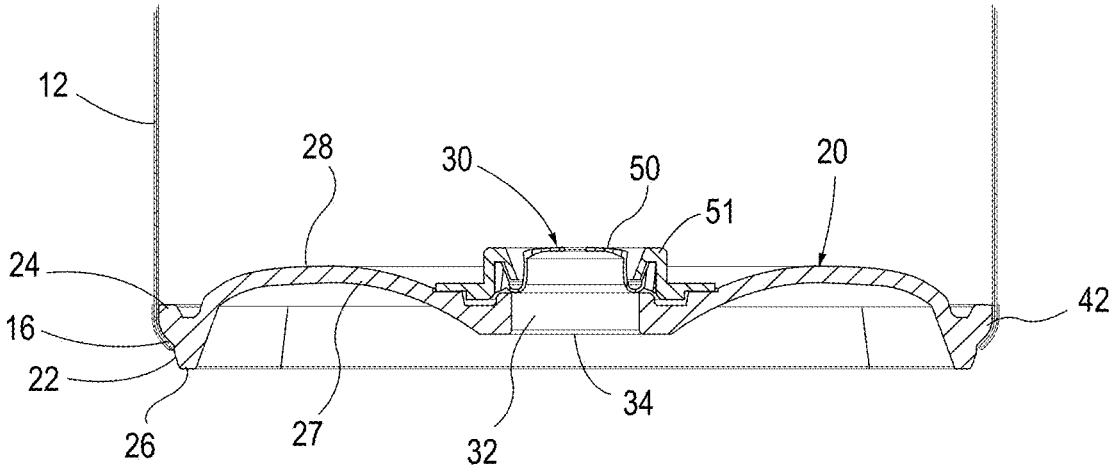
FIG. 4 is a cross section view of a lower portion of a squeezable fiber-based bottle according to the present disclosure.
Figure 5D:
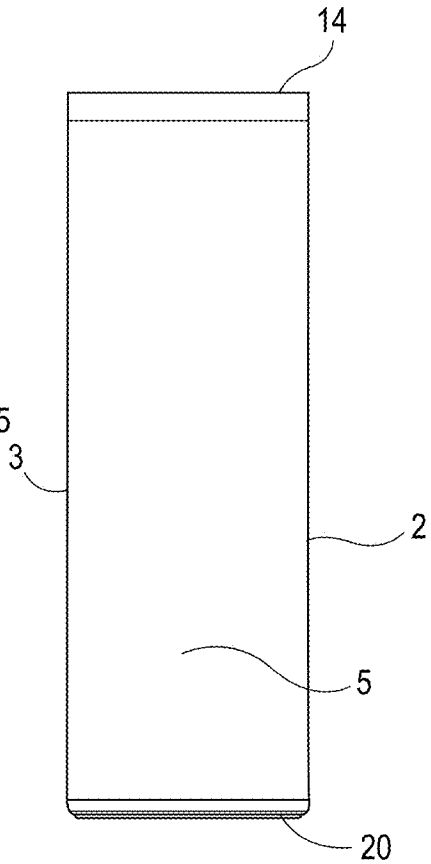
FIG. 5*d* is a front view of the bottle shown in FIG. 5*b*.
Figure 5C:
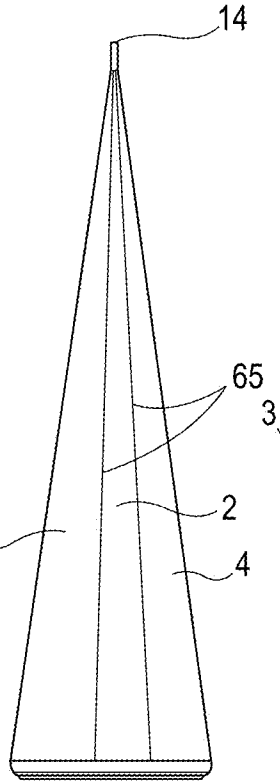
FIG. 5*c* is a side view of the bottle shown in FIG. 5*b*.
Figure 5B:
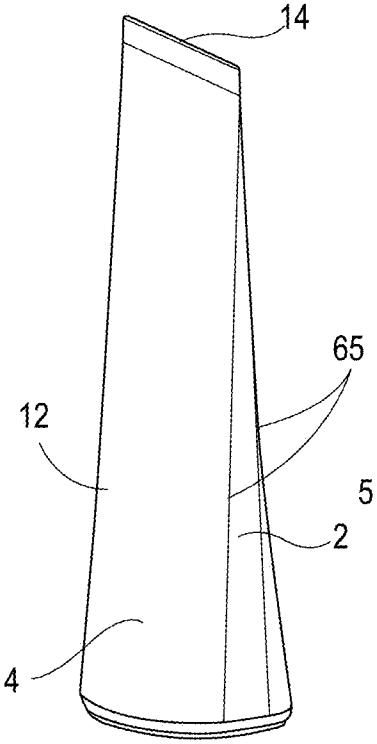
FIG. 5*b* is a perspective view of the squeezable fiber-based bottle shown in FIG. 5*a* showing the bottle standing upright.
Figure 5A:
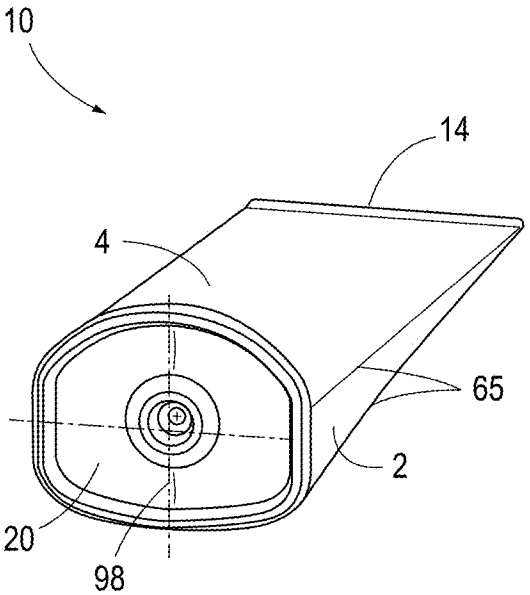
FIG. 5*a* is a perspective view of squeezable fiber-based bottle showing the bottom view of the molded base according to the present disclosure.
Figure 6D:
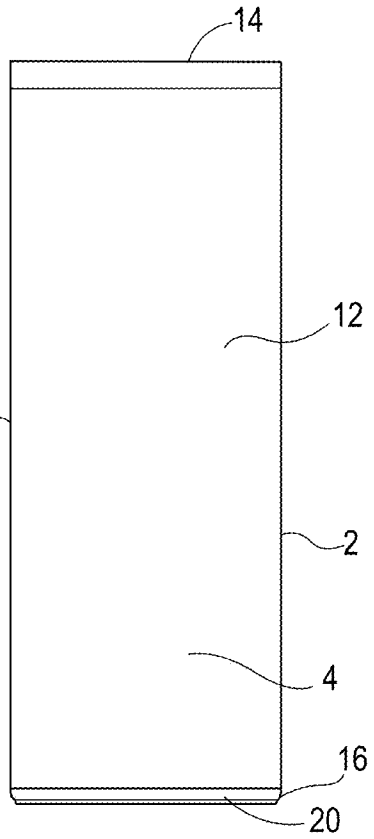
FIG. 6*d* is a front view of the bottle shown in FIG. 6*b*.
Figure 6C:
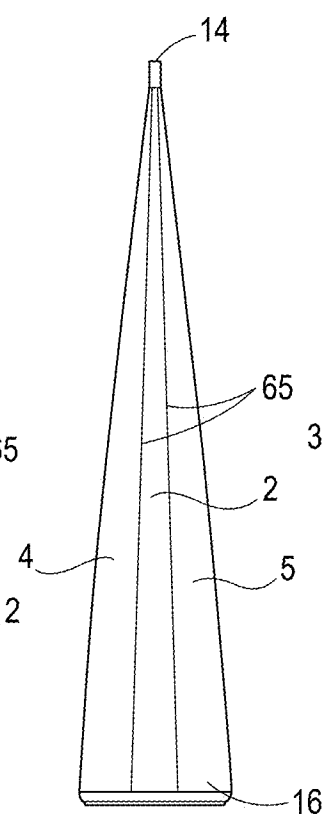
FIG. 6*c* is a side view of the bottle shown in FIG. 6*b*.
Figure 6B:
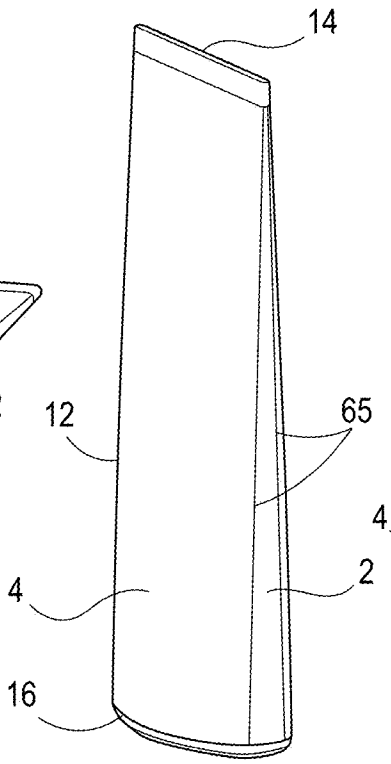
FIG. 6*b* is a perspective view of the squeezable bottle shown in FIG. 6*a* showing the bottle standing upright.
Figure 6A:
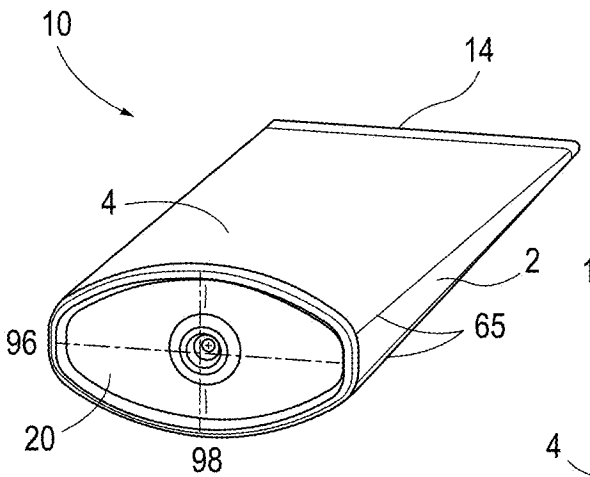
FIG. 6*a* is a perspective view of squeezable fiber-based bottle showing the bottom view of the molded base according to the present disclosure.

FIG. 4 is a cross sectional view of the exemplary squeezable fiber-based bottle 10 showing the assembled fiber-based side wall 12 attached to the molded base 20. The molded base 20 can be injection molded thermoplastic polymers preferably in high density polyethylene (HDPE) or polylactic acid (PLA). Preferably the molded base 20 is made by a bio-based or post-consumer recycled grade. The polymer can include some fillers to enhance the renewable content such as cellulose fibers or non-fibrillated wood particles in the polymer matrix as taught in U.S. Pat. Nos. 8,722,773 and 11,504,878. The base can also be made of fibers and fully encapsulated by a polymeric film or water dispersion applied or spray or dip coating. The base can also be made by compression molding.

As shown in FIG. 4, the molded base 20 includes a base perimeter having an external perimeter surface 22 with an upper edge 24 and a lower edge 26. The lower edge 16 of the fiber-based side wall 12 is attached to the molded base 20 forming an impermeable seal 42 between the fiber-based sidewall 12 and the external perimeter surface 22. The lower edge of the fiber-based side is disposed near the perimeter surface upper edge 24 but not the perimeter surface lower edge 26. Preferably, the lower edge 16 of the fiber-based side wall 12 is at least 1 mm from the perimeter surface lower edge 26. The perimeter surface of the molded base 20 can include a ledge (not shown) to accommodate the lower edge 16 of the fiber-based side wall 12. The ledge is preferably at least 1 mm from the perimeter surface lower edge 26. The impermeable seal 42 is formed about the entire external perimeter surface 22 of the molded base 20. Preferably the impermeable seal 42 is formed by welding such as by exposing the area to hot air. However other means of creating an impermeable seal 42 can be considered such as ultrasonics or applying a glue.

As illustrated in FIG. 4, the aperture 30 for dispensing viscous fluid extends into a duct 32 disposed on the bottom surface 27 of the molded base 20 which is the side opposite the liquid containing surface 28. The duct 32 can include a duct opening 34 and a flexible, resilient, slit-type valve 50 disposed on the duct opening 34. The slit valve 50 is configured to (1) permit fluid flow in response to a predetermined discharge pressure within the bottle when squeezed and (2) automatically close to shut off the flow when the pressure is reduced. Designs of such valves and of fitments using such valves are illustrated in the U.S. Pat. Nos. 5,271,732, 5,927,446, 5,942,712, 6,545,901 and 10,287,066. The slit valve 50 can be selected based on the desired dispensing experience and product viscosity to adjust the seal pressure, cracking pressure as well as flow rate vs. pressure profile. Preferably the product viscosity can be between 3,000 to 30,000 cps 10 $s^{-1}$ and more preferably between 5,000 to 20,000 cps $10s^{-1}$. The slit valve 50 is preferably molded from a resilient flexible material that is inert to the fluid product being packed and dispensed. In a preferred embodiment, the slit valve 50 can be molded in liquid silicone rubber. Examples of commercially available silicone rubber grades are DC-99-525 and RBL-9525-54 sold by Dow Corning Corp. in the United States of America. The valve 50 can include other elastomers, such as a synthetic, thermosetting, or thermoplastic polymers or thermoplastic elastomers, including those based upon materials such as thermoplastic propylene, ethylene, and styrene, including their halogenated counterparts. The valve 50 can also be formed as a unitary structure from a film of material that is flexible, pliable, elastic, and resilient as disclosed in U.S. Pat. No. 10,287,066 and include linear low-density polyethylene (LLDPE), low density polyethylene (LDPE), LLDPE/LDPE blends, acetate, acetal, ultra-high-molecular-weight polyethylene (UHMW), polyester, urethane, ethylene-vinyl acetate (EVA), polypropylene, and high-density polyethylene. The slit valve 50 can be mounted on the liquid containing surface 28 of the molded base 20 and sandwiched between the molded base 20 and a plastic roundel 51 via snap molding or heat stacking or ultrasonic welding. The slit valve 50 can also be sandwiched between the plastic roundel 51 and another small plastic mating part (not shown). The plastic roundel 51 can be assembled to the molded base 20 via snap molding or heat stacking or ultrasonic sealing. It was found that ultrasonic sealing can produce a strong sealing bond. This configuration is particularly advantageous to ensure the valve 50 doesn't accidentally eject while dispensing the product. In some embodiments, the slit valve 50 can also be made from thermoplastic polymers and integrated with the base (not shown). The molded base perimeter surface lower edge 26 is below the liquid containing surface 28, the duct opening 34, and slit valve 50 allowing the squeezable fiber-based bottle 10 to stand vertically. The molded base includes means to avoid dispensing through the valve during transportation or handling if pressure is accidentally exerted through the side wall 12. This can be a molded closure (not shown). The slit valve 50 can also include a mechanism to prevent dripping or leakage during transport for lower viscosities such as from 300 to 3000 cps 10s−1 as disclosed in U.S. Pat. Nos. 10,611,531. Preferably, the valve 50 can be sealed with a removable lid using a metalized laminate attached to the molded closure with a pressure sensitive adhesive (not shown).

FIG. 5*a* through 5*d* show a preferred embodiment of exemplary squeezable fiber-based bottle 10 wherein the that upper edge 14 of the fiber-based side wall 12 is contained within the footprint of the base 20, such that the length of the upper edge 14 is less than or equal to the length and the width of the molded base 20 measured along the major axis 96 and minor axis 98, respectfully. This configuration was found to be particularly advantageous to enable a better grip than conventional round or oval cosmetic tubes at parity with filling volumes, especially for large sizes. Particularly, the squeezable fiber-based bottle of this disclosure was found to provide optimal ergonomics for sizes up to 500 ml while current paper cosmetic tubes are typically limited to 250 ml filling volume. Another benefit is a better evacuation of the content and dispensing control. A further benefit is to provide a smaller footprint compared to traditional cosmetic tubes with equivalent filling volumes.

FIG. 6*a* through 6*d* show another preferred embodiment of exemplary squeezable fiber-based bottle 10. In this embodiment, the front panel 4 and back panel 5 have the same curvature. Preferably the maximum length (i.e., measured along the major axis 96)/maximum width (i.e., measured along the minor axis 98) of the molded base is 66 mm and 44 mm, respectively. Preferably, the upper edge 14 of the fiber-based side wall 12 has a length that is less than or equal to the length and the width of the molded base 20 such that upper edge 14 is contained within the footprint of the molded base 20. This configuration was found particularly advantageous to minimizing need to readjust the grip on the squeezable fiber-based bottle 10 during use.

Figure 7A:
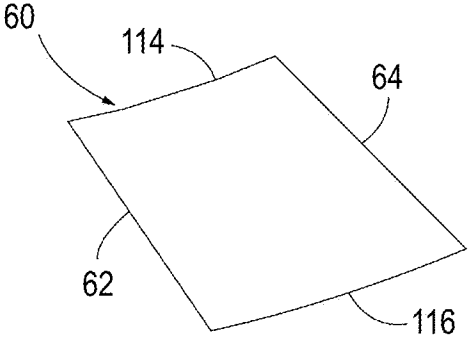
FIG. 7*a* thru 7*f* show the steps used in forming the squeezable fiber-based bottle according to the present invention.
Figure 7B:
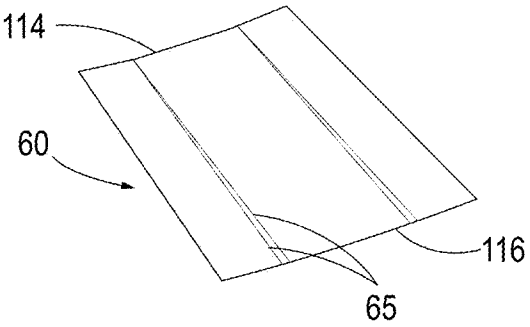
Figure 7C:
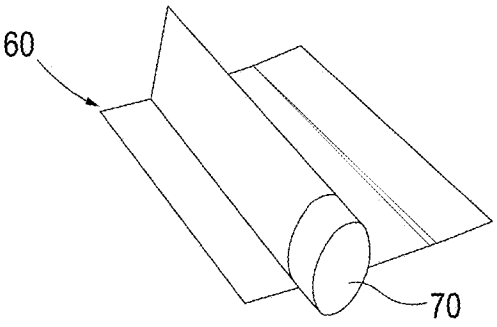
Figure 7D:
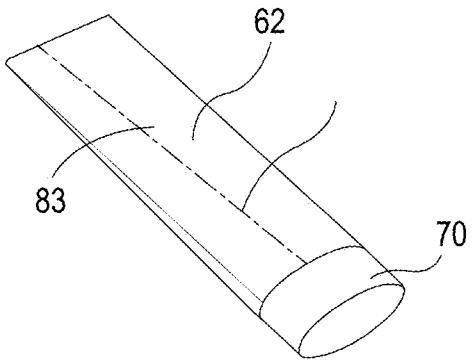
Figure 7E:
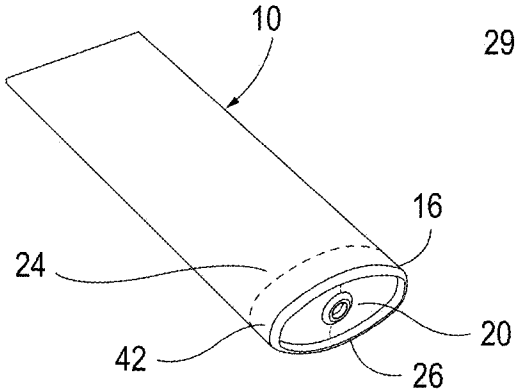
Figure 7F:
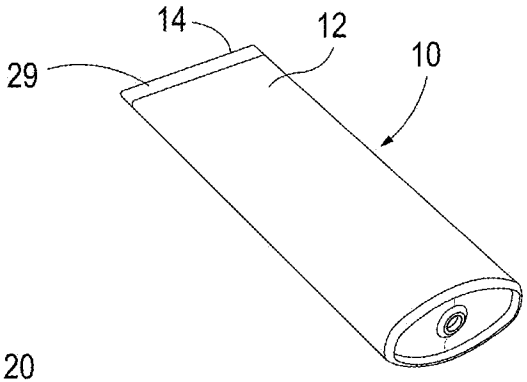

FIG. 7*a* through 7*f* illustrate a method of forming an exemplary squeezable bottle 10 according to the present disclosure. The method comprises the steps of a) Cutting a piece of planar elongated blank 60 from a liquid packaging board sheet or web, the blank 60 has a first side edge 62, a second side edge 64, an upper edge 114 and a lower edge 116 as shown in FIG. 7*a*.

b) Creasing the blank 60 such that the crease lines 65 extends from the upper edge 114 to the lower edge 116 of the blank 60 as shown in FIG. 7*b*.

c) Securing the blank 60 to a fixture 70 corresponding to the shape of the bottle to be manufactured as shown in FIG. 7*c*.

d) Folding the blank 60 around the fixture 70 so that the first side edge 62 and the second side edge 64 overlap as shown in FIG. 7*d* and applying ultrasonic or heat-sealing energy and pressure to the overlapping first edge 62 and second edge 64 to form a hermetically sealed seam 83 and to form a monolithic bottle shape with two open ends. Preferably the seam 83 is a butt seam type or overlapped side seam type with a smooth outer surface. For instance, the seam 83 does not include a hump in the overlapped region.

e) Sealing a molded base 20 to the lower edge 16 of the side wall 12 creating an impermeable seal 42 and then removing the fixture from inside the bottle 10 as shown in FIG. 7*e*. The molded base has a perimeter surface with an upper edge and a lower edge. The lower edge 16 of the side wall 12 is disposed near the perimeter surface upper edge 24 of the molded base but not the perimeter surface lower edge 26.

f) Filling the bottle 10 through the open end at the upper edge 14 of the side wall 12 with the content and sealing the side wall 12 upper edge 14 forming an upper seal 29 as shown in FIG. 7*f*.

This method can be preferred to fill the bottle 10 in a similar fashion to current tubes.

An alternate method of forming the exemplary squeezable bottle 10 can comprise the steps of:

a)-d) As above e) Removing the fixture from inside the bottle 10 and sealing the upper edge 14 of the side wall 12 f) Filling the content and sealing the molded base 20 to the lower edge 16 of the side wall 12 creating an impermeable seal 42.

This alternative method can be preferred to ship the bottle body in a stacked configuration to optimize space, while still maintaining ergonomic benefits.

The (1) impermeable longitudinal seal 83 connecting the two side wall edges 62, 64 and extending from the lower edge 16 to the upper edge 14, (2) the impermeable seal 42 connecting the fiber-side wall 12 to the molded base 20 as well as (3) the upper seal 29 of the fiber-based side wall 12 can all include means to protect exposed edges from edge water wicking in order to avoid catastrophic integrity failures or unwanted deformation. Edge wicking is particularly problematic in the areas where a liquid carton board edge is cut ("raw edge") and exposed to water such as when the bottle is used in shower. Edge wicking of boards has been amply studied e.g., Harju 2018 Liquid penetration in food service boards, Master Science thesis. Several methods are known in the art to provide an edge protection such as spraying of a sizing or other hydrophobic agent, skiving, hemming, or covering the cut edge with an adhesive plastic strip. Edge protection methods for the upper seal 29 could employ spray, dip coating, adding a PE-PET-PE strip or folding. Solutions to apply an edge protection to the longitudinal seal 83 are known in the art as described in WO2022185176 or U.S. Pat. No. 11,691,791.

Figure 8C:
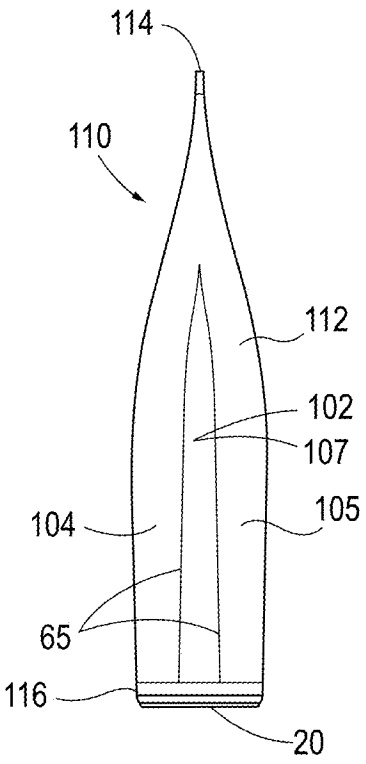
FIG. 8*a* shows a blank used in forming the squeezable bottle according to the present disclosure.
FIG. 8*b* is a perspective view of a squeezable fiber-based bottle formed from the blank shown in FIG. 8*a*.
FIG. 8 *c* is a side view of the squeezable fiber-based bottle shown in FIG. 8*b* according to the present disclosure.
Figure 8B:
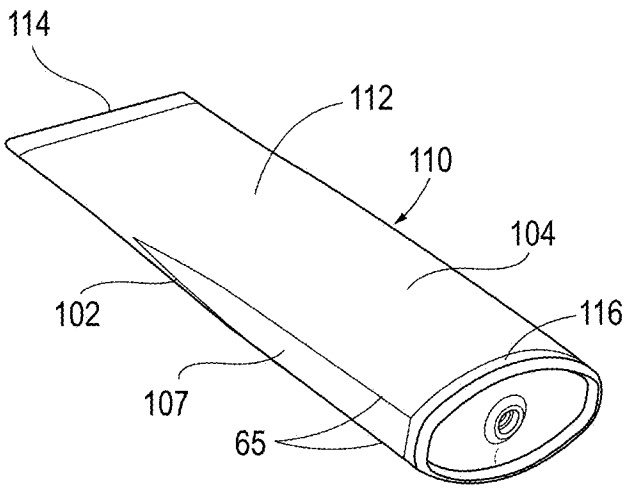
Figure 8A:
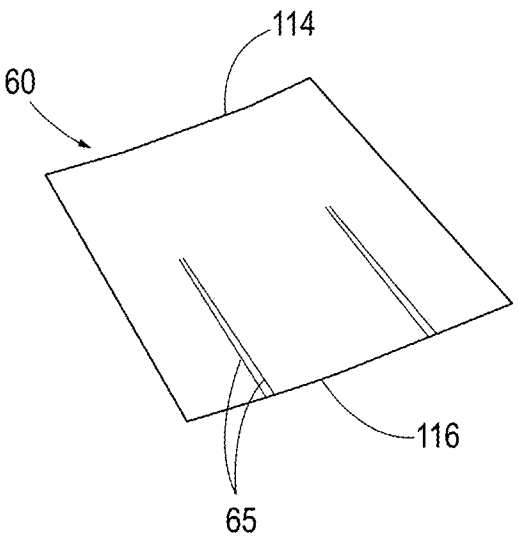

FIG. 8*a* illustrates an alternative method of creasing the blank 60 after cutting. According to this method, crease lines 65 extend only partially from the lower edge 116 in the direction of the upper edge 114. This results in a squeezable fiber-based bottle 110 having a flat side portion 107 not extending for the whole length of the side panel 102 but only in the lower portion expected to be gripped by the user as shown in FIG. 8*b*. FIG. 8*c* shows a side view of exemplary squeezable bottle 110 formed from a blank with partial creasing where the creases 65 extend from the lower edge 116 less than the full length of the side panel 102. The squeezable fiber-based bottle 110 shown in FIG. 8*c* was found to have a better filling volume efficiency than the squeezable fiber-based bottle 10 shown in FIG. 6*c* which was formed using the same molded base and blank 60 but where the creases 65 extend the full length of the side panel 2 from the lower edge 16 to the upper edge 14. Specifically, it was found that for the embodiment shown in FIG. 8*c*, the front panel 104 and back panel 105 were not as stiff near the upper edge 114 as the font panel 4 and back panel 5 for the embodiment shown in FIG. 6*c*.

The squeezable fiber-based bottle of the present disclosure preferably includes creasing or scoring of the liquid carton used to form the side wall. Benefits of creasing and scoring include: (a) minimizing the bending stiffness of the liquid carton board to increase squeezability, (b) increasing grip between the tube and the hand especially in wet conditions, (c) maximizing product restitution by allowing consumers to fold/roll-up the side wall as the squeezable fiber-based bottle is used.

Figure 9A:
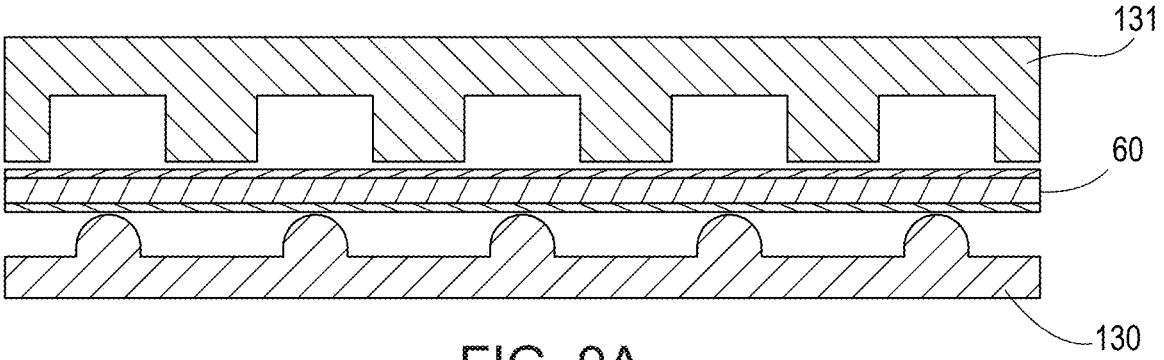
FIG. 9*a* is a side view of equipment used to crease the liquid carton board forming the fiber-based side wall of the squeezable bottle according to the disclosure.
Figure 9B:
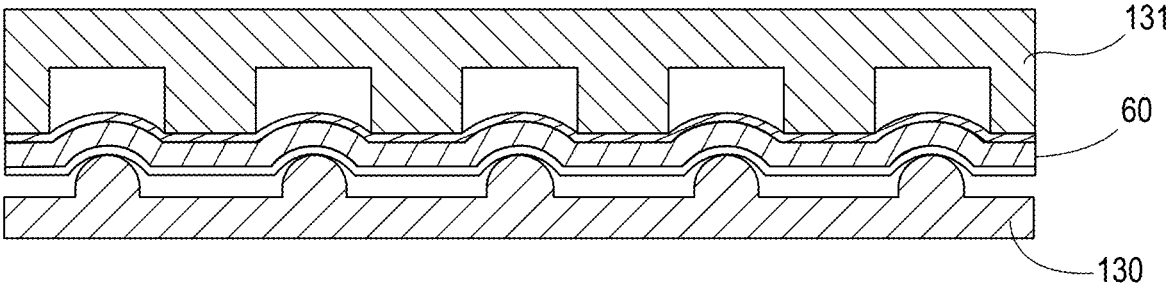
FIG. 9*b* is a side view of the equipment shown in FIG. 9*a* showing the equipment creasing the liquid carton board.

FIG. 9*a* and FIG. 9*b* show a manufacturing method used to crease the liquid carton board web or sheet 60. Specifically, FIG. 9*a* shows the undeformed liquid carton board 60 before creasing. FIG. 9*b* shows the carton board 60 being pushed by the creasing rule 130 into an accurately cut groove in the make-ready (matrix or counter-die) 131, on which the carton board sheet 60 is located. This results in a geometry where the board 60 has local variations of curvature while maintaining its overall nominal wall thickness.

It was found that a deeper creasing depth can increase board 60 panel flexibility when squeezed almost like creating a living hinge. Preferably, the ratio between crease depth and width should be between 2:1 and 1:2 and more preferably 1:1. For this application, it is preferred to use boards including bleached chemical pulp and particularly SBB (Solid Bleached Board) due to their exceptional mechanical properties and delamination/micro-cracks resistance especially for deep and narrow creases.

Figure 10C:
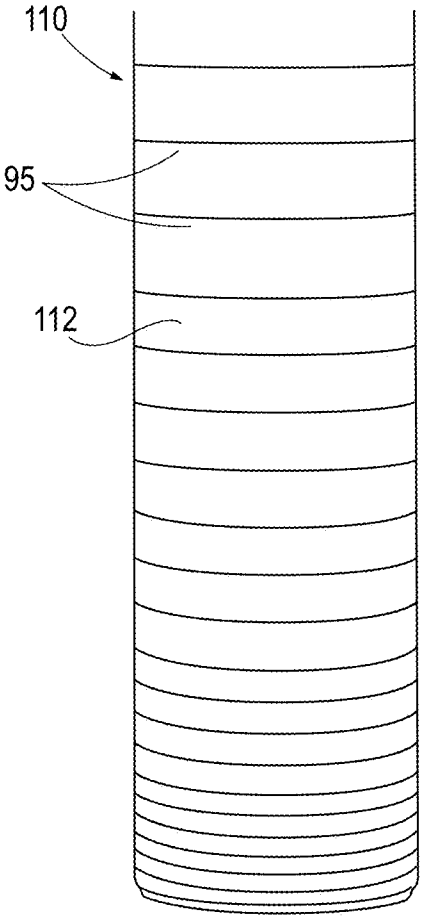
FIG. 10*a* through 10*f* are side views of the squeezable fiber-based bottle showing texture panels in the side wall according to the present disclosure.
Figure 10B:
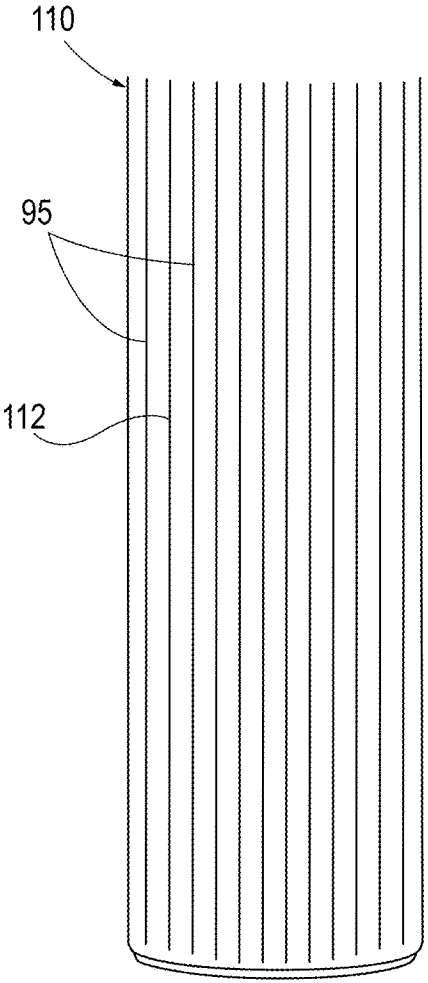
Figure 10A:
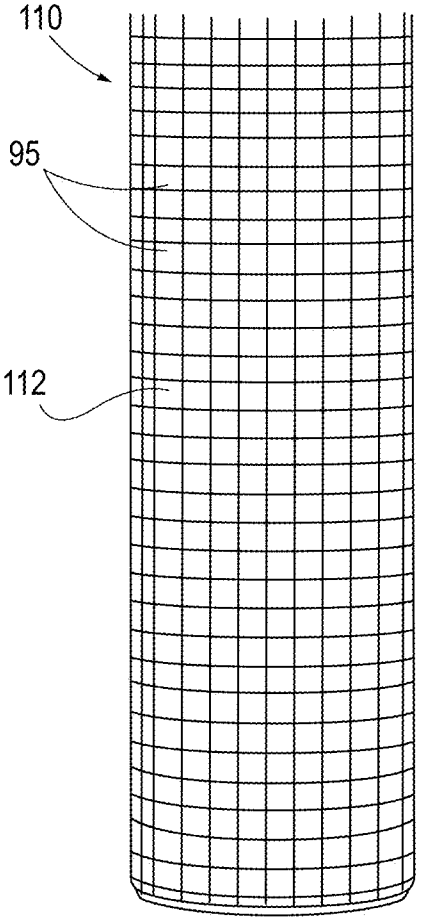
Figure 10F:
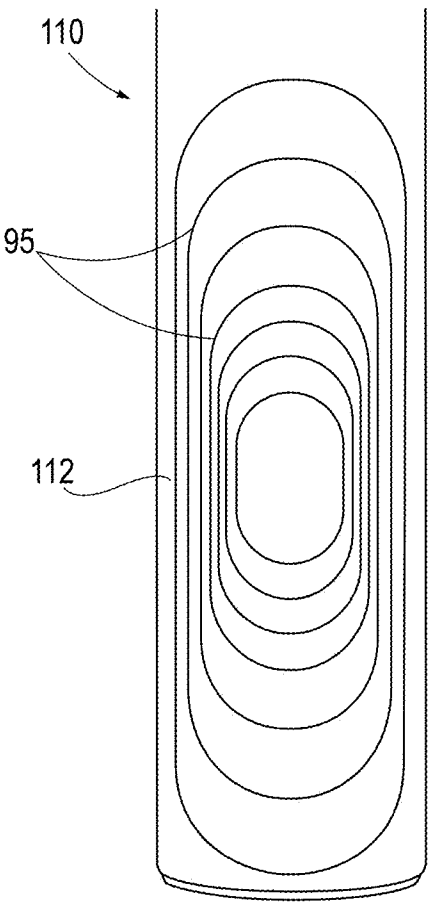
Figure 10E:
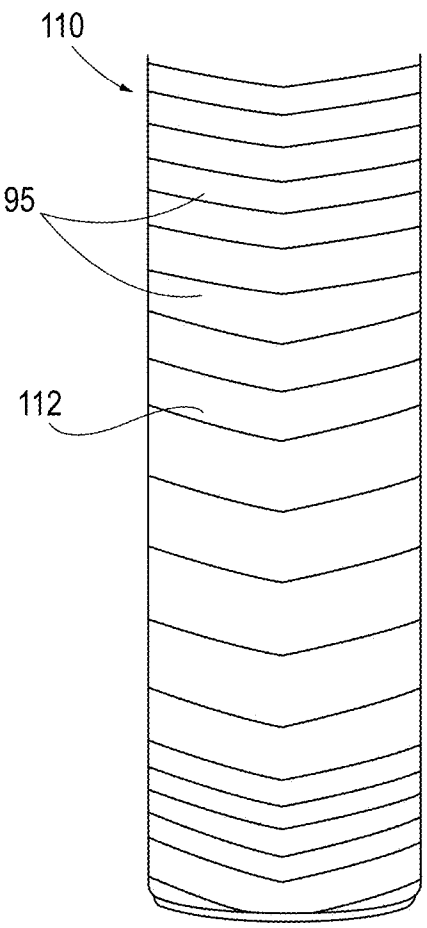
Figure 10D:
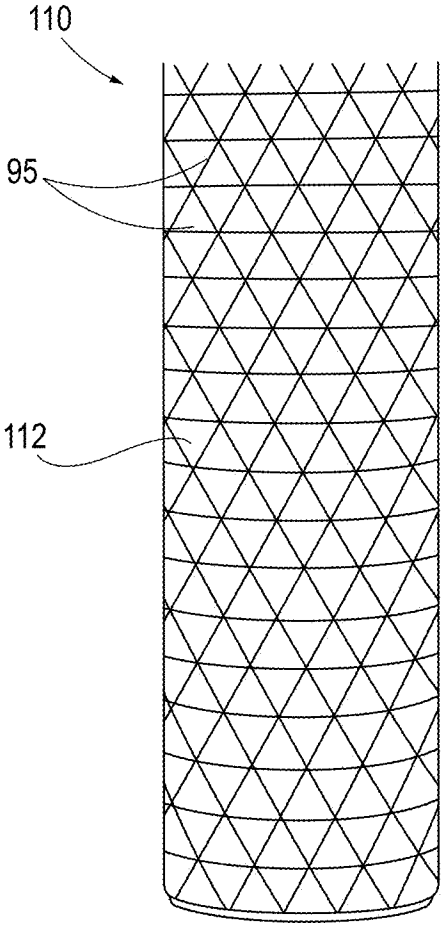

FIG. 10*a* through FIG. 10*f* show non-limiting examples of texture patterns 95 on the side wall 112 obtained using the creasing method described in FIG. 9*a* and FIG. 9*b* to increase the functionality and usability of the squeezable fiber-based bottles as well as providing aesthetic benefits. Specifically, FIG. 10*a* shows the exemplary squeezable bottle 110 with a pattern found to be particularly effective to provide a good grip by increasing the contact area between the hand holding the package and the side wall surface and ultimately high friction. FIG. 10*b* shows the exemplary squeezable bottle 110 with a pattern 95 found to be particularly effective to enhance grip in wet conditions by better draining of the water accumulating on the surface. FIG. 10*c* shows the exemplary squeezable bottle 110 with a pattern 95 found to be particularly effective to allow more complete extraction of product from the package via folding/rolling the package resulting in less waste. FIG. 10*d* shows the exemplary squeezable bottle 110 with a pattern 95 found to be particularly effective in decreasing the local bending stiffness of the wall to decrease squeezing force required to dispense product. FIG. 10*e* shows the exemplary squeezable bottle 110 with a pattern 95 found to be particularly effective to better indicate the direction of dispensing. FIG. 10*f* shows the exemplary squeezable bottle 110 with a pattern 95 found to be particularly effective to better communicate where to squeeze the bottle 110 for optimal performance.

Figure 11A:
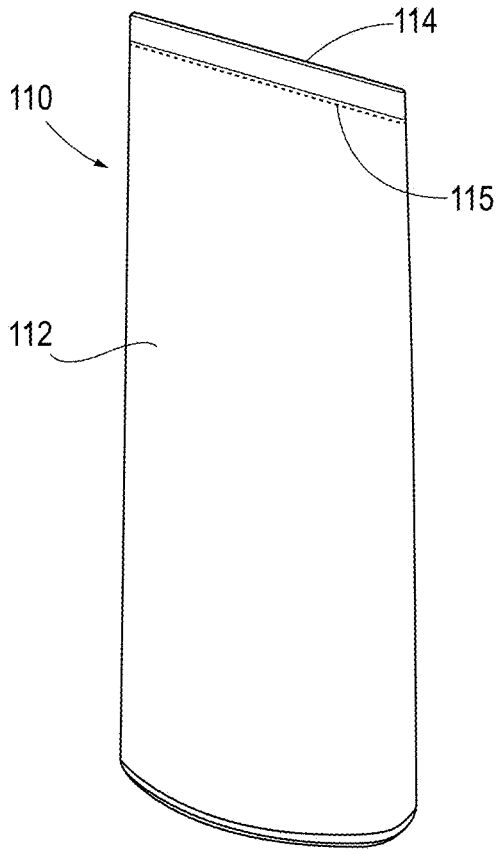
FIG. 11*a* is a perspective view of a squeezable bottle including score lines near the upper edge of the side wall according to the present disclosure.
Figure 11B:
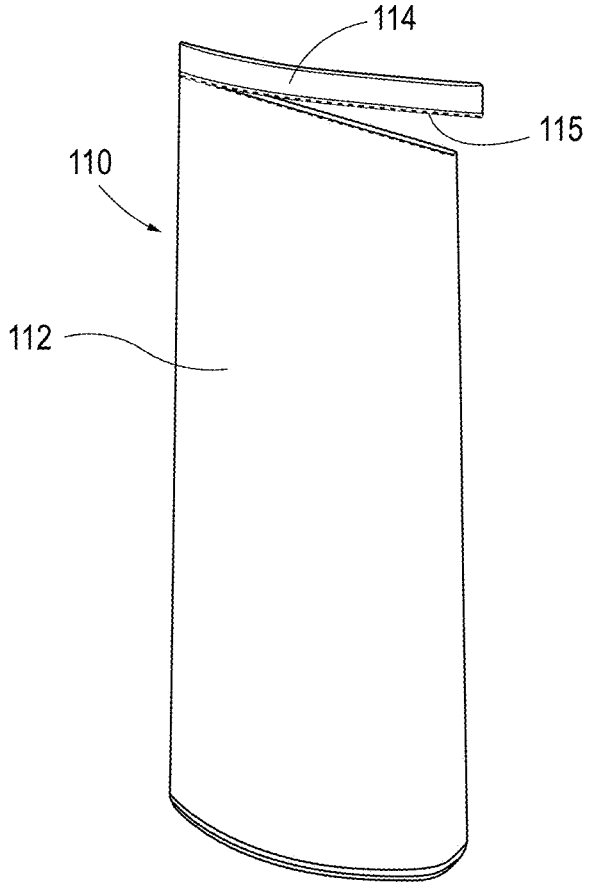
FIG. 11*b* is a perspective view of a squeezable fiber-based bottle shown in FIG. 11*a* showing the score lines separated near the upper edge of the side panel according to the present disclosure.

FIG. 11*a* shows an exemplary squeezable fiber-based bottle 110 with score lines 115 on the side wall 112 in the area just beneath the sealed upper edge 114. As shown in FIG. 11*b*, the score lines 115 enable the user to tear open the top of the bottle at the end of life to both enable access to any remaining products in the bottle as well as clean wash the product chamber to remove any residuals before disposal. The score lines 115 are formed using a knife penetrating either the board web or the blank for 30% of the depth using a process called grooving. The location of the score lines underneath the upper edge 114 minimizes the chance of causing accidental tears during bottle dispensing.

Figure 12C:
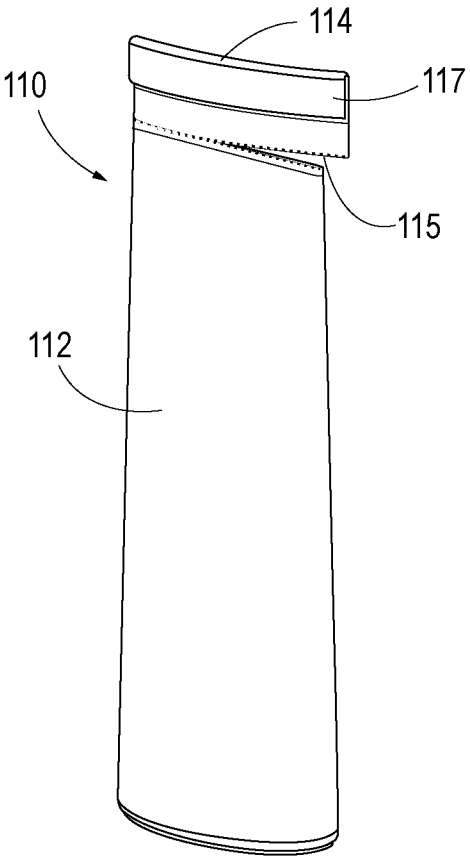
FIG. 12*c* is a perspective view of the bottle in FIG. 12*b* showing the score lines separated below the folded upper edge.
Figure 12B:
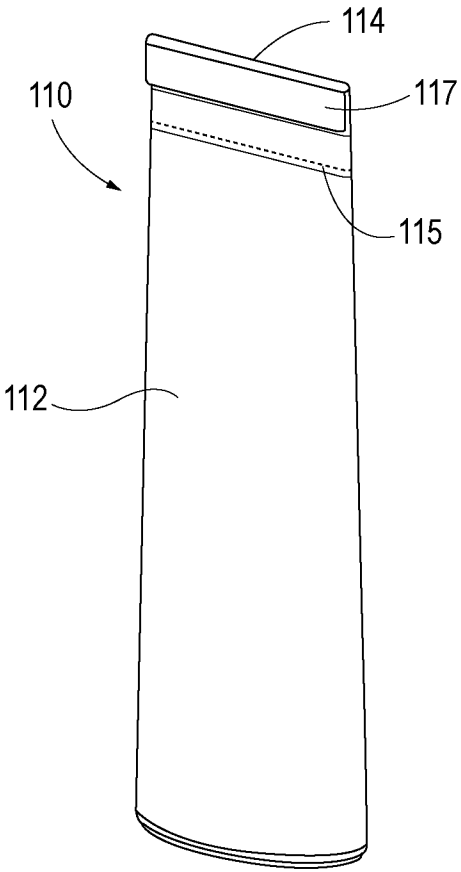
FIG. 12*b* is a perspective view of the bottle in FIG. 12*a* including score lines below the folded upper edge.
Figure 12A:
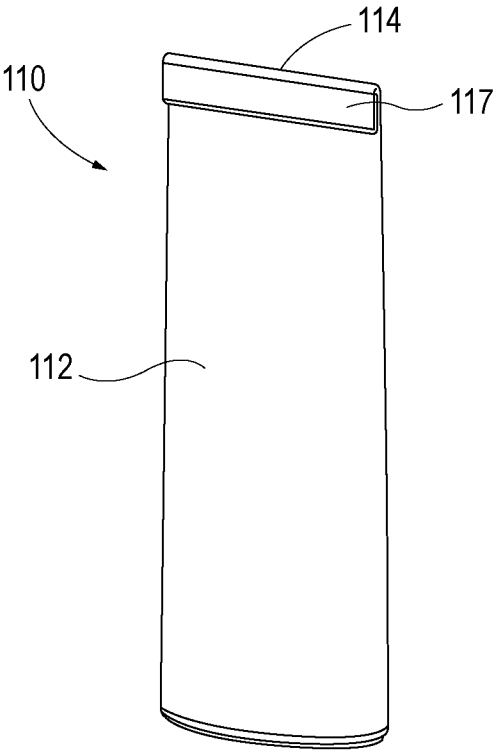
FIG. 12*a* is a perspective view of the squeezable bottle showing a fold in the upper edge.

FIG. 12*a* shows an exemplary squeezable bottle 110 with score lines 115 (not shown) on the side wall 112 in the area just underneath the sealed upper edge 114, wherein the scored area is partially or totally covered by a simple fold 117. This construction is preferred for less stiff liquid boards to prevent accidental opening of the score lines during normal tube operation. According to this construction, a user first unfolds the fold 117 in the upper edge 114 exposing the score area 115 as shown in FIG. 12*b* and then tears open the top of the bottle 110 to access the bottle 110 interior as shown in FIG. 12(*c*). This construction can also be executed with other folding patterns for the upper edge such as a double or saddle folds (not shown).

Figure 13:
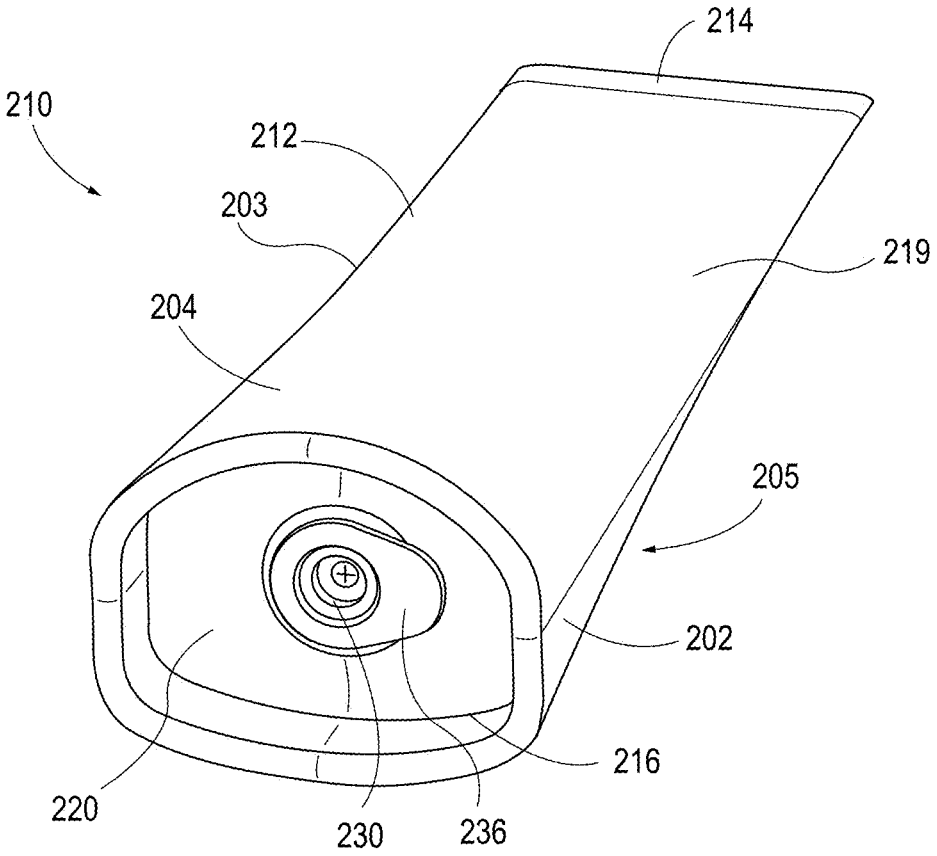
FIG. 13 is a perspective view of a squeezable fiber-based bottle according to the present disclosure.

FIG. 13 is an isometric view of an exemplary squeezable fiber-based bottle 210 showing the assembled fiber-based side wall 212 attached to a liquid packaging board molded base 220. The side wall has an upper edge 214, a lower edge 216 attached to the base 220, a front panel 204, a back panel 205, two opposite side panels 202,203 and a pair of opposite side edges overlapping to form a side seam (not shown). The molded base 220 can be made starting from a liquid packaging board blanket, heated and thermoformed to achieve a specific shape before assembly.

The substrate of the liquid packaging board forming the fiber-based side wall 212 preferably contains lignocellulosic fibers obtained by any conventional pulping process, including bleached or unbleached chemical, mechanical, chemi-mechanical pulping processes. The carton board can be made from more than one ply, typically 3 plies, and is usually in the form of a fibrous web. Preferably the carton board has a grammage from 170-430 gsm and more preferably about 250 to 350 gsm. Preferably the functional layers can be on both the inner surface forming the liquid containment portion and the outer surface 219. The most inner and most outer layers are preferably low-density polyethylene (LDPE) layers to ensure good sealing and liquid tightness. The LDPE in the most outer layer also ensures protection from moisture pick-up from splash or wet handling. The LDPE also ensures that after consumer disposal and household collection the NIR detector in industrial sorting facilities can positively identify the bottle and divert the package to the used beverage carton recycling stream where multi-material packages are effectively recycled and the fiber regained for future use. For example, the liquid carton board may be a multilayer structure comprising one or more layers made of bleached sulphate pulp. The liquid carton board may comprise a top layer made of bleached sulphate pulp, a middle layer made of chemi-thermomechanical pulp CTMP, a back layer made of bleached sulphate pulp and a polyethylene PE layer on the outer surface of the top layer and the back layer. The liquid carton board used can be products of the Finnish company Stora Enso marketed with trademarks Natura™ 2PE Board or Natura™ Barr. Natura™ 2PE Board is a bleached liquid packaging board with a three-layer fiber construction, with two outer layers made of bleached sulphate pulp and a middle layer made of CTMP (chemi-thermo-mechanical pulp). Its top and reverse sides are polyethylene PE coated with no inclusion of any additional high barrier coating. Natura™ Barr is a bleached liquid packaging board with a three-layer fiber construction, with two outer layers made of bleached sulphate pulp and a middle layer made of CTMP (chemi-thermo-mechanical pulp). It has a polyethylene PE coating on the top side and a multilayer high-barrier coating on the reverse side. The functional layer can include barrier layers such as high density polyethylene (HDPE), a foil, or a thin coating from metallization, applications of cellulose fibers or water dispersible nanocomposites including nanoplatelets. Alternatively, both the inner and outer coating can be a polymeric water dispersion, such as BASF Joncryl or Down RhobarrD. The water dispersions can be applied by a variety of techniques such as dip, rod, doctor blade, knife, gravure, reverse roll, air knife, and forward roll or spray followed by a drying step. An example of carton boards using water-based dispersion coatings are Cupforma Natura Aqua+ commercialized by Stora Enso and ISLA commercialized by Kotkamills. Preferably, the aperture 230 can be sealed with a removable lid using a metalized laminate attached to the molded closure with a pressure sensitive adhesive (not shown).

Figure 14:
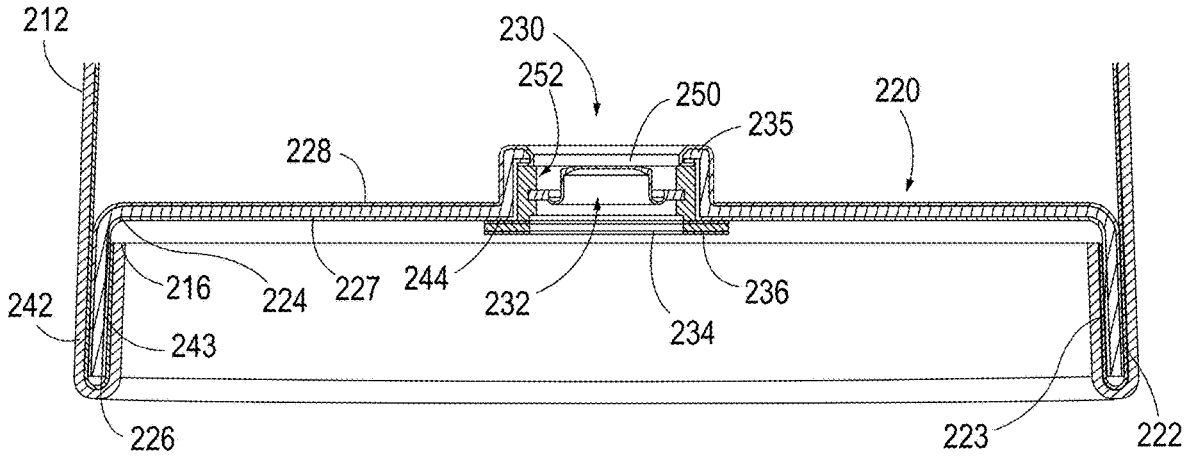
FIG. 14 is a cross section view of a lower portion of a squeezable fiber-based bottle shown in FIG. 13.

FIG. 14 is a cross section view of the exemplary squeezable fiber-based bottle 210 shown in FIG. 13 showing the assembled fiber-based side wall 212 attached to a liquid packaging board molded base 220. In this embodiment a base perimeter inner surface 223 is in a recessed portion of the molded base 220 and the lower portion of the fiber-based sidewall is wrapped around the lower edge 226 of the molded base 220 so that the lower edge 216 of the fiber-based side wall is near a perimeter surface upper edge 224 but not the perimeter surface lower edge 226. Preferably, the lower edge 216 of the fiber-based side wall 212 is at least 1 mm from the perimeter surface lower edge 226. The fiber-based sidewall 212 is attached to the base perimeter external surface 222 and the lower edge 216 of the fiber-based side wall 212 is attached to the base perimeter inner surface 223. An impermeable seal 242 is formed between the fiber-based side wall 212 and the base perimeter external surface 222. An impermeable seal 243 is also formed between the fiber-based side wall 212 lower edge 216 and the base perimeter inner surface 223 such that the lower edge 216 is disposed near the perimeter surface upper edge 224 but not the perimeter surface lower edge 226. The seal between the base perimeter inner surface 223 and the lower edge 216 can be strengthened by applying a knurling pattern. Preferably both the impermeable seals 242 and 243 are formed by welding such as exposing the area to hot air. However other means of creating the impermeable seals 242 and 243 can be considered such as ultrasonics or applying a glue/adhesive. As illustrated in FIG. 14, the aperture 230 for dispensing viscous fluid extends into duct 232 disposed on the bottom surface of the molded base 220 which is the side opposite the liquid containing surface 228. The duct can include a duct opening 234 and a flexible, resilient, slit-type valve 250 disposed in the duct opening 234. In a preferred embodiment the exposed edges 235 of the fiber-base molded base 220 facing the duct opening 234 are skived to prevent liquid wicking. However, other solutions can also be employed to prevent liquid wicking such as spraying, masking, etc. In the embodiment illustrated in FIG. 14, the valve 250 is mounted on a valve holder 252 assembled via an interference fit with a recessed area of the liquid packaging board molded base 220. The valve holder 252 assures reliable mounting tolerance and assembly. The valve holder 252 can be made out of more than one piece to facilitate mounting with the valve 250. A lip 236 using liquid carton board can be attached to the bottom surface 227 of the molded base 220 to form a temporary seal 244. The lip 236 can include a pull tab to break the temporary seal 244, access and remove the valve holder 252 prior of package disposal and/or recycling. Preferably, the aperture 230 can be sealed with a removable lid using a metalized laminate attached to the molded closure with a pressure sensitive adhesive (not shown).

Figure 15:
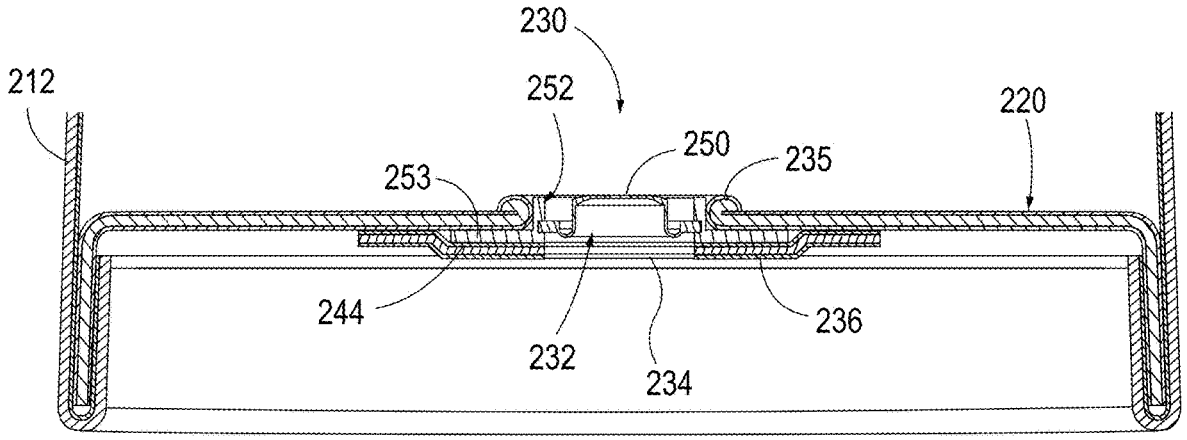
FIG. 15 is a cross section view of a lower portion of a squeezable fiber-based bottle shown in FIG. 13 showing an alternate valve arrangement.

FIG. 15 shows an alternate valve assembly embodiment, wherein the valve holder 252 includes flaps or a disc portion 253 laminated to the liquid packaging board molded base 220. The valve holder 252 can be assembled to the molded base 220 either before or after the assembly of the molded base 220 to the side wall 212 of the fiber-based bottle 210. This design is particularly preferable to assemble the valve holder 252 to the molded base 220 using ultrasonic welding to produce a very strong seal. The disc flange can carry one or more energy director ribs (not shown). In an example, valve holders 252 were sealed by a 20 kHz ultrasonic welder type "2000Xd" (Branson, Brookfield, Connecticut) with an unstructured custom built sonotrode and anvil. Tear strengths of over 60 N were found with at ~650 ms sealing time, 20 μm amplitude, 60 psi sealing pressure. As showed in FIG. 15, the exemplary fiber-base bottle can include an additional lip 236 also laminated with flaps or disc portion 253 of the valve holder 252 forming a temporary seal 244. The lip 236 can also include a pull tab (shown in FIG. 13) to break the temporary seal, access and remove the valve holder 252 prior of package disposal and/or recycling. Preferably, the aperture 230 can be sealed with a removable lid using a metalized laminate attached to the molded closure with a pressure sensitive adhesive (not shown).

Figure 16:
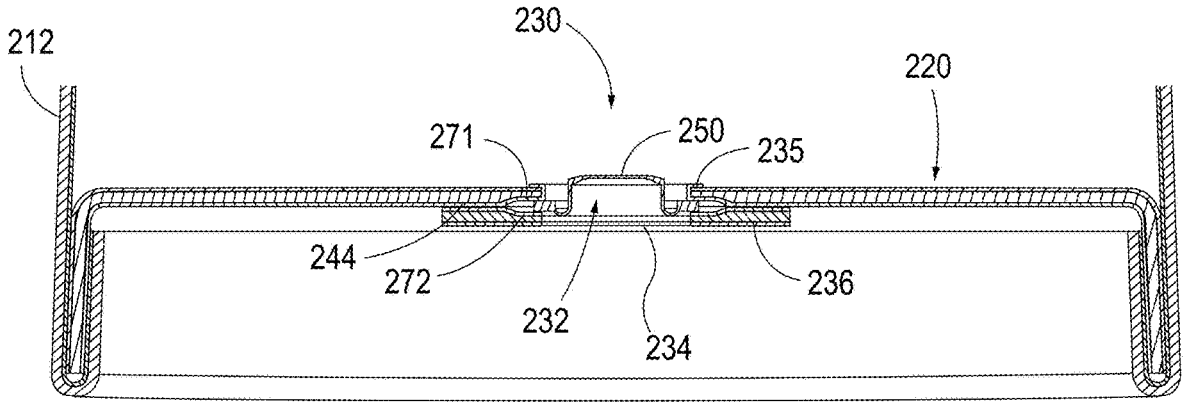
FIG. 16 is a cross section view of a lower portion of a squeezable fiber-based bottle shown in FIG. 13 showing an alternate valve arrangement.

FIG. 16 shows an alternate valve assembly embodiment, wherein an elastomeric valve 250 such as silicone is sandwiched between two laminated board surfaces 271 and 272. This arrangement is particularly beneficial for easy valve removal as the silicone valve can be easily extracted once the lip 236 is removed due to its low adhesion via temporary seal 244 to the board surfaces. In a preferred embodiment the exposed edges 235 of the fiber-base molded base 220 facing the duct opening 234 are skived to prevent liquid wicking. However other solutions can also be employed to prevent liquid wicking such as spraying, masking, etc. Preferably, the aperture 230 can be sealed with a removable lid using a metalized laminate attached to the molded closure with a pressure sensitive adhesive (not shown).

Figure 17:
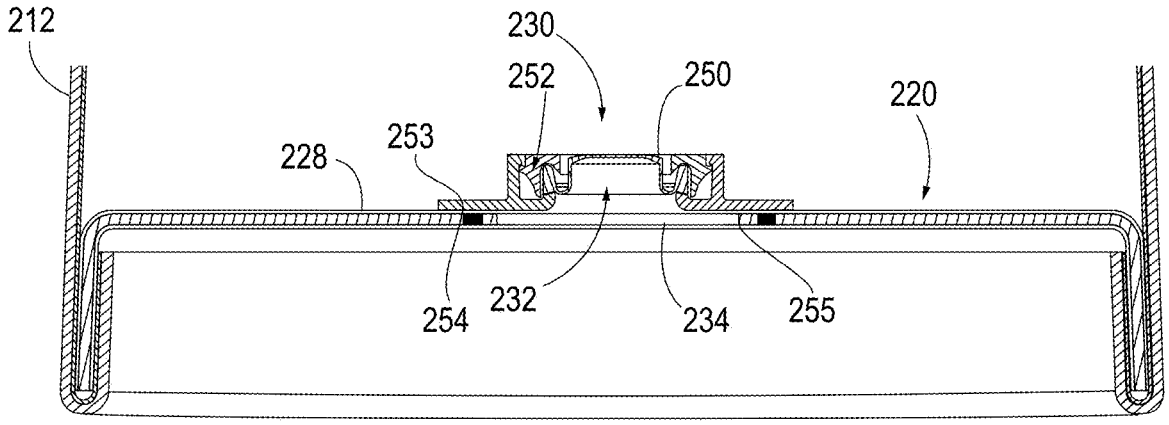
FIG. 17 is a cross section view of a lower portion of a squeezable fiber-based bottle shown in FIG. 13 showing an alternate valve arrangement.

FIG. 17 shows an alternate valve assembly embodiment, wherein the flaps or disc portion 253 of valve holder 252 is laminated on the liquid containment surface 228 of the liquid packaging board molded base 220. Similar to the exemplary construction of FIG. 15, a strong bond of the valve holder to the molded base 220 can be achieved via ultrasonic welding: in this case, the disc flange can carry one or more energy director ribs 254. This configuration is also particularly advantageous to promote valve holder seal integrity to the molded base 220 as flange 253 acts as an element contrasting inner pressure. This embodiment is also particularly advantageous to protect the exposed raw edge 255 from product exposure. Preferably, the aperture 230 can be sealed with a removable lid using a metalized laminate attached to the molded closure with a pressure sensitive adhesive (not shown).

Methods

1) Individual Layer Thickness

The thickness of the overall film/individual layers is measured by cutting a 20 μm thick cross-section of a film sample via sliding microtome (e.g. Leica SM2010 R), placing it under an optical microscope in light transmission mode (e.g. Leica Diaplan), and applying an imaging analysis software.

2) Caliper

The caliper, or thickness, of a single-layer test sample is measured under a static load by a micrometer, in accordance with compendial method ISO 534, with modifications noted herein. All measurements are performed in a laboratory maintained at 23° C.±2° C. and 50%±2% relative humidity and test samples are conditioned in this environment for at least 2 hours prior to testing. Caliper is measured with a micrometer equipped with a pressure foot capable of exerting a steady pressure of 70 kPa±0.05 kPa onto the test sample. The micrometer is a dead-weight type instrument with readings accurate to 0.1 micron. A suitable instrument is the TMI Digital Micrometer Model 49-56, available from Testing Machines Inc., New Castle, DE, or equivalent. The pressure foot is a flat ground circular movable face with a diameter that is smaller than the test specimen and capable of exerting the required pressure. A suitable pressure foot has a diameter of 16.0 mm. The test sample is supported by a horizontal flat reference platform that is larger than and parallel to the surface of the pressure foot. The system is calibrated and operated per the manufacturer's instructions. Measurements are made on single-layer test samples taken from rolls or sheets of the raw material, or test samples obtained from a finished package. When excising the test sample from a finished package, use care to not impart any contamination or distortion to the sample during the process. The excised sample should be free from residual adhesive and taken from an area of the package that is free from any seams or folds. The test sample is ideally 200 $mm^2$ and must be larger than the pressure foot. To measure caliper, first zero the micrometer against the horizontal flat reference platform. Place the test sample on the platform with the test location centered below the pressure foot. Gently lower the pressure foot with a descent rate of 3.0 mm per second until the full pressure is exerted onto the test sample. Wait 5 seconds and then record the caliper of the test sample to the nearest 0.1 micron. In like fashion, repeat for a total of ten replicate test samples. Calculate the arithmetic mean for all caliper measurements and report the value as Caliper to the nearest 0.1 micron.

3) Basis Weight

The basis weight of a test sample is the mass (in grams) per unit area (in square meters) of a single layer of material and is measured in accordance with compendial method ISO 536. The mass of the test sample is cut to a known area, and the mass of the sample is determined using an analytical balance accurate to 0.0001 grams. All measurements are performed in a laboratory maintained at 23° C.±2° C. and 50%±2% relative humidity and test samples are conditioned in this environment for at least 2 hours prior to testing. Measurements are made on test samples taken from rolls or sheets of the raw material, or test samples obtained from a finished package. When excising the test sample from a finished package, use care to not impart any contamination or distortion to the sample during the process. The excised sample should be free from residual adhesive and taken from an area of the package that is free from any seams or folds. The test sample must be as large as possible so that any inherent material variability is accounted for. For flat samples, measure the dimensions of the single layer test sample using a calibrated steel metal ruler traceable to NIST, or equivalent. For non-flat samples, the area can be calculated using 3D data. Calculate the Area of the test sample and record to the nearest 0.0001 square meter. Use an analytical balance to obtain the Mass of the test sample and record to the nearest 0.0001 gram. The weight of a coating can be obtained by subtracting the weight of the coated from the uncoated samples. Calculate Basis Weight by dividing Mass (in grams) by Area (in square meters) and record to the nearest 0.01 grams per square meter (gsm). In like fashion, repeat for a total of ten replicate test samples. Calculate the arithmetic mean for Basis Weight and report to the nearest 0.01 grams/square meter.

4) Pinholing Test Method

This is a test method to detect and locate any pin hole equal or greater than 10 μm on a coated surface. The part to test is placed on an absorbent surface with the coated side facing up. Then a dye penetrant solution according to ASTM F3039-23 is spread across the surface under test, preferably using an eye dropper or pipette and a small roller to apply pressure on the surface to ensure adequate contact. The dye penetrant solution should contact all areas exhibiting questionable surface anomalies taking care not to allow dye penetrant solution to flow over the edge of the sample. Wipe excess dye from sample using a clean absorbent pad and carefully lift the sample. The test is passed if there is no evidence of dye penetration or staining to the opposite side of coated surface.

5) Bottle Leakage Test Method

This is a test method to measure the ability of the bottle and closure system to prevent leakage when stored or transported.

A minimum of three representative empty bottles of the type being tested are preconditioned for at least 24 hours at 22±3° C., 60%±10 RH. Prepare a tap water solution at room temperature adding a dye such as Rhodamine or Toluidine to give a permanent indication where there is leakage. Fill the specimen at lab ambient temperature with the water/dye solution to expected fill capacity e.g., 150±1 ml, fitted with their respective closure (if applicable) and hermetically closed in the storage configuration. Dry (if needed) the finish and shoulder areas of the bottles with a (paper) towel so that no product remains on them. Place the specimen in a flat position on a tray capable of holding the liquid should a leak develop. Place some absorbent blotting paper beneath the specimen to detect leakage more easily. Then put the specimen in storage at 25±3° C., 60%±10 RH. No weight or other bottles must be placed on top of the specimen being tested. Alternative specimen orientations during the test can be considered such that suspected leak areas are covered with the liquid inside the container. Inspect for liquid leakage at 24 h, after 1 week and after 2 weeks. Note location(s) of any eventual leakage.

If there is leakage to the outside of the specimen, the package fails the test. If there is no leakage to the outside of the specimen the package passes the test.

6) Water Vapor Transmission Rate (WVTR) Test Method

The water vapor transmission rate (WVTR) is defined as the mass of water vapor penetrating through the membrane per unit area, per unit time, and it is used as a parameter for measuring water barrier properties. The measurement is conducted according to the ASTM E96 Inverted Cup Water Method. For this test, impermeable cups such as the "vapometer" E96 cups from Thwing-Albert Instrument Co. are filled with 50 g of water. The mouth of the cup is 3070 square millimeter in area. The cups are made of noncorroding material, impermeable to water or water vapor. The flat portion of the specimen under measurement is cut into circles slightly larger than the opening of the cup. At least three specimens should be tested representative of the materials and condition being tested. The test specimen is sandwiched between two gaskets and placed on the cup mouth flange assuring the correct orientation. The specimen is then secured to the cup by creating an impermeable seal by tightening an open screw lid. The cups are then weighted with a balance of a resolution of at least 0.01 g. Place the cups on a flat tray making sure the water is in direct contact covering the specimen being tested. Then put the cups in storage at 25±3° C., 60%±10 RH. Note the cups should be placed in such a way that the air flow is not restricted over the exposed surface. The cups are then weighted daily for at least 7 days. The rate of weight change of a specimen is at steady state when that rate is essentially constant over a period that is a minimum of six consecutive weight measurements. Where a straight line adequately fits the plot of at least six properly spaced points (periodic weight changes matching or exceeding 20% of the multiple of 100 times the scale sensitivity), steady state is assumed. If the rate of weight is not at steady state, the storage period should be extended.

If the target part to characterize is not flat and/or the coating is not homogeneous e.g., made from spray or dip coating application, the water transmission rate is measured on a representative flat specimen made according to the same process with the same materials and characterized such that both average substrate and coating thicknesses are matching the ones from target part's within +/−20% tolerance.

The barrier water vapor transmission rate (WVTR) after thermoforming process can be calculated based on water vapor permeability theory, and there are two critical information needed. The first one is the intrinsic barrier material properties of water vapor permeability coefficients changing with thickness, and the second one is the barrier thickness changing after thermoforming. In the study, the water vapor permeability coefficient relationship with thickness were achieved by data regression process using WVTR values using ASTM F1249 (AMETEK, MOCON) of different film sample thicknesses. For the thickness profiles after thermoforming, it can be attained by either physical measurement of film sample from thermoforming or virtual thermoforming model prediction. Once we have this critical information, the WVTR after the thermoforming process can be predicted according to Permeability theory. These WVTR predictions are confirmed using a modified ASTM E96 desiccant method with custom metal sample holders. The sample holders are designed to create a hermetic seal between the cavity containing the bentonite clay desiccant, the thermoformed barrier film, and the surrounding controlled atmosphere. Following the ASTM E96 method, samples are weighed at repeatedly over a specified duration; the resulting graph with time (days) and weight gain (grams) is fitted with a linear regression. The slope of the line is reported and normalized by the area of the thermoformed liner and reported as the WVTR.

7) Weight Loss Test Method

This method is used to determine the water weight loss through a container or individual components such as the vessel and cover. A minimum of three representative empty specimens of the type being tested are preconditioned for at least 24 hours at 23±2° C., 60%±10 RH.

Then the specimens are filled with specified amount of tap water, or another specified personal care composition at lab ambient temperature to their filled capacity fitted with their respective closure/cover (if applicable) and hermetically closed in the storage configuration. Any different type of closure such as aluminum foil with paraffin should be noted. Dry (if needed) any outer surfaces with a (paper) towel so that no product remains on them.

For flat components, such as the lidding film, the measurement is conduced according to a variant of the ASTM E96 Inverted Cup Water Method. For this test, impermeable cups such as the "vapometer" E96 cups from Thwing-Albert Instrument Co. are filled with 50 g of water or specified personal care composition. The mouth of the cup is 3070 square millimeter in area. The cups are made of noncorroding material, impermeable to water or water vapor. The flat portion of the specimen under measurement is cut into circles slightly larger than the opening of the cup. At least three specimens should be tested representative of the materials and condition being tested. The test specimen is sandwiched between two gaskets and placed on the cup mouth flange assuring the correct orientation. The specimen is then secured to the cup by creating an impermeable seal by tightening an open screw lid.

The weight of the filled covered vessel or cup is recorded with a balance of a resolution of at least 0.01 g. Then specimens are placed in storage at 25±3° C., 60%±10 RH or another relevant testing condition. The specimen should be placed such that the water or the product under test is in direct contact with the specimen being tested. If ASTM E96 cups are used, the cups should be placed in such a way that the air flow is not restricted over the exposed surface. The weight is recorded daily for 2 weeks. The daily weight loss is calculated once the gradient is stabilized at "steady state". The surface area of the container is calculated. The weight loss is calculated and reported averaging the daily weight loss per a square meter at 25° C., 60% RH or in the relevant tested condition. The test is not applicable if the weight loss doesn't reach a steady state such as in case of a package failure leading to a leak.

8) Water Resistance Test Method

This method simulates heavy use in a wet environment. Bottles are filled with Pantene PRO-V Repair & Protect shampoo or another specified personal care composition at the specified filled capacity e.g., 150±1 g and then preconditioned for a minimum of 24 hours at 22±3° C., 60%±10 RH.

Then 5 g±1 of content is dispensed from the container; the package is submerged in water for 8 minutes and subsequently dried for 10 minutes. This sequence represents a heavy use cycle. This test cycle is repeated for 19 times. A minimum of 3 bottles are tested.

Test requirements are met if no integrity or performance failure is observed in any of the bottles which renders the package not usable at the completion of all 20 heavy use cycles.

9) Bottle Squeeze Test Method

This method is used to measure how much force is necessary to dispense a certain amount of product from a bottle. Bottles are filled with Pantene PRO-V Repair & Protect shampoo or another specified personal care composition at the specified filled capacity e.g., 150±1 g and then preconditioned for a minimum of 24 hours at 22±3° C., 60%±10 RH. The bottles are fitted with their respective closure to ensure no leaks.

Each bottle is then placed in a compression tester using a fixture to simulate a squeezing event. An example of compression tester is Z010TN All-round by ZwickRoell GmbH & Co. KG. The load probe has a ¾ inch stainless steel ball attached simulating a thumb pressing on the bottle panel. The bottle is placed horizontally relatively to the load column with the front panel facing up by fixing one bottle extremity at one end resting on two curved aluminum supports (simulating fingers) just about the opposite direction where the load is applied. The bottle is adjusted to ensure the load is applied in the center of the panel and in the middle between the neck (or the bottle base) and the other bottle extremity. Then the probe is lower to contact the bottle reaching a max preload of 0.5 N. A scale with a precision of +0.01 g with a collector plate is placed underneath the package to collect the product dispensed from the orifice during squeezing. The closure is opened making sure no product is leaking from the orifice before the squeeze test. Sometimes it is necessary to re-orient the bottle.

Then the load is applied to the filled bottle at 20 mm/sec until a 10 mm displacement is reached. Then, the probe is returned to the start position and another 2 load cycles are performed. The total amount of product dispensed is weighted. A minimum of 3 bottles are tested in total.

Test requirements are met if both the average product collected from each dispensing event from all tested bottles is at least 1 g and all bottles survive the test with no catastrophic failures compromising the bottle functions such as leaking.

10) Recycling Sorting Test

The test is conducted with a TOMRA Autosort NIR Equipment (TOMRA ACT operation system). The whole package is placed in the NIR testing stand, and test result is report of the main classifier in the field of view. Those classifiers are specific for each sorting plant installation, and we report here the predominate classifier form key sorting plant in Europe. If the classifier is "Tetrapak" then this indicates that the package is diverted to the Used Beverage Carton bale in the sorting center.

11) Recyclability in Pulp Stream Based on PTS-RH 021 CAT 2

The testing is carried out with a representative amount of at least 250 g of oven-dry material of the packaging type under test as intended to be disposed by consumers. The first step is to isolate, dry remove and weight non-paper constituents which can be easily separated such as closures, etc. The test material is reduced to specimens of about 2 cm×2 cm and the moisture content determined according to DIN EN ISO 287:2009-09. About 50±1 g of the test material is then disintegrated in a procedure according to DIN EN ISO 5263-1:2004-12. For this purpose, a total volume of 2,000 ml of specimen is defibrated in a standard disintegrator without prior swelling at a consistency of 2.5%. The disintegration time is 20 minutes, the speed is 3000 rpm, and the temperature of the tap water 40° C. Then, the fiber suspension such obtained is homogenized according to ZM V/6/61. For this purpose, the specimen is transferred into a distributor, diluted with tap water to a form a diluted stock with a consistency of 0.5% and homogenized for about 5 minutes.

Then, the disintegratability is tested after the Zellcheming method ZM V/18/62. For this purpose, the total stock is screened for 5 minutes without any further chemical additive by means of a Brecht-Holl fractionator using a perforated plate with a hole diameter of 0.7 mm. The residue is washed into a 2 liters tank and dewater it through a filter inserted in a Büchner funnel. The filter is folded once and placed in an oven to dry at 105° C. up to weight constancy. Then, the reject is visually inspected and the weighted. To calculate the total reject content, the proportion of removed-dry non-pulp constituents is also included. The fiber yield can be derived from the difference between the (oven-dry, 100%) initial material and the total reject. Products are rated "recyclable" is the total reject does not exceed 20%; "recyclable, but worthy of product design improvement" if the total reject is between 20% to 50%; and "not reasonably usable in paper recycling" if the total reject is above 50% to the initial material input respectively.

For evaluating the undisturbed sheet formation criterion, the total stock is first screened in a procedure after the Zellcheming method ZM V/1.4/86. For this purpose, the total stock is fractionated for 2 minutes by means of a Haindl fractionator using a slot plate of 0.15 mm. The passing fraction, which is hereinafter referred as to 'accept' is then collected. Then, the accept is used to form a sheet on a Rapid Köthen sheet former after DIN EN ISO 5269-2:2005-03. Two handsheets of 1.8 g are formed of about 60 gsm. The drying temperature is about 96° C. For the sheet adhesion test, a dried handsheet together with a couch carrier board and a cover sheet are sandwiched between two brass plates and placed in a drying oven where a full surface pressure of 1.18 kPa is applied for 2 minutes. Next, the specimens are placed in an exicator where they are allowed to cool down for 10 minutes, then they undergo the sheet adhesion test and the visual inspection for any optical inhomogeneities.

For the sheet adhesion test, the carrier board and the cover sheet are one by one slowly peeled off the handsheets. While doing so, the test operator checks for potential adhesion effects. Also, the surfaces of the handsheet, cover sheet and carrier board are inspected for any damage or adhesion of the handsheet. The product is considered "recyclable" is no adhesion effect is observed; "limitedly recyclable due to the tackiness in the prepared fiber stock" if some little adhesion effects are observed with slight damage; "not recyclable due to the tackiness in the prepared fiber stock" if adhesion effect with damage is observed.

Then the handsheets are inspected under transmitted light for the presence of any flaws, transparent and white spots, or dirt specks from inks, coating, paint, lamination, and adhesive particles. In addition, the sheets are evaluated for stain from any dark colorants. The product is considered "recyclable" if no or non-disturbing optical inhomogeneities are observed, "limitedly recyclable due to optical inhomogeneities in the prepared fiber stock" if disturbing optical inhomogeneities are observed and "not recyclable due to optical inhomogeneities in the prepared fiber stock" if unacceptable optical inhomogeneities are observed.

12) Flat Crush Test

In a flat crush test, the empty bottle is placed sideways on a plate. A vertical load of 45 N with a cylinder of 6 cm of diameter is applied on the bottle body. The test is passed if the bottle is permanently deformed in a substantially flat configuration.

13) Burst Strength Test

In a burst strength test, the empty bottle or tube is screwed into a neck gauge fitment and placed between two pressure blocks mounted on a vice. Pressure is applied slowly and evenly through the valve or tube opening until 20 psi (137.89 kPa) is reached and maintained for 15 seconds. During the test, the valve area should be properly sealed to ensure that the applied pressure is directed exclusively through the valve to prevent any leakage or bypass of pressure. Repeat for 3 samples. The test is passed if the empty bottle or tube withstands the specified pressure range without failure.

14) Adhesion Bond Test

The Adhesion bond test is used to determine the strength of the bond between the sidewall and the base of the bottle. First, points must be marked on side wall where the impermeable seal intersects the minor and major axis of the base. Then 4 vertical lines needs to be drawn orthogonal to the impermeable seal. Taking these lines as center, strips 12.7 mm wide must be cut starting as close as possible to the base without compromising the impermeable seal. Place two opposing strips in the grips of the instrument. Set the crosshead speed at 12.7 cm/min. Record the maximum force and note whether the failure was a peel from the shoulder or a tear of the material. Repeat the test on the remaining two strips of the sample. Repeats for 3 samples. No peel failures with force values <45 N for 12.7 mm (½ inch) strips.

TABLE OF EXAMPLES

| | Ex. 1 Commercial paper tube with paper laminate board and plastic cap | Ex. 2 Fiber-based bottle with New Natura ® 2PE board and molded base (as shown in FIG. 6) |
|---|---|---|
| Filled weight | 200 g | 170 g |
| Base-width/depth | 48 mm/48 mm | 65 mm/42 mm |
| Upper edge | 75 mm | 65 mm |
| Wall stock | Paper laminate 9.5 g | New Natura ® 2PE 14 + 257 + 24 295 gsm 8.9 g |
| Fiber % wall stock | 68% | 87% |
| Base | HDPE 2.4 g | HDPE + Silicone rubber |
| Closure | Orifice dia.: 1.5 mm | slit valve 2.2 g |
| Fiber %, total | 54% | 70% |
| Leakage and Pinholing | Passed | Passed |
| WVTR side wall, g/sqm/day at 25° C. 60% RH | 2.5 | 10.2 |
| WVTR base, g/sqm/day at 25° C. 60% RH | <0.5 (closure) | <0.5 |
| Water resistance test | Met | Met |
| Squeezing test | Met | Met |
| dose, force at 10 mm deflection | 1.6 g ± 0.2/38N ± 7 (leave-on conditioner) | 9.0 g ± 0.6/31N ± 5 (leave-on conditioner) |
| Adhesion bond test | Met | Met |
| Burst Strength | Met | Met |
| Flat crush test | Met | Met |
| Recycling Sorting Test | LCB stream | LCB stream |
| Paper recyclability (PTS-RH-021/97 cat 2) | 51% | 67% |
| Disintegrability (fiber recovery %, target 80%, recyclable worthy of design improvement >50%) | | |
| Undisturbed sheet formation | | |

Examples

Table 1 includes examples of squeezable bottles that could be used to store and dispense consumer products. All bottles of these examples have a comparable size and filled weight. All bottles assessed were found not leaking and free of pinholes larger than 10 microns. The bottles were tested for fiber content, shower integrity according to the water resistance method, squeezability, flat crush, sorting using NIR and re-pulpability. The side wall and the base of the bottles of these examples were also assessed for moisture vapor barrier performance.

Example 1 discloses a commercially available paper tube using a liquid carton board for the side wall, a welded polyethylene shoulder with integrated cap. The squeeze test was performed using tubes filled with a commercially available leave-on conditioner commercialized by Garnier in Germany as Wahre SchätzeHonig Schätze. While this tube can be considered squeezable by the test method disclosed, the dispensing experience is sub-optimal. By applying a deflection of 10 mm, it was found that an average squeezing force of 38N for an average product dispensed 1.6 g when the tube is full. By using pressure sensors, it was found that consumers typically exert squeezing forces around 20-30N, rarely exceeding 50 N. A squeezing force of above 35N producing a deflection of 10 mm is not desired. It was also found that an average product tube dispensed at least 5 g of product by squeezing the tube with a 20 mm deflection. However, this required squeezing forces exceeding 50N and resulted in permanent indentation/deformation of the tube.

Example 2 discloses a squeezable fiber-based bottle as shown in FIG. 6 with an injection molding HDPE base and a side wall including a double-sided carton board. In this example, the upper edge is 65 mm. The upper edge matches the base width to allow consumers to hold/squeeze the bottle comfortably from both side-to-side as well as front-to-back. The base depth is 42 mm to fit securely into the hand when holding/squeezing from front to back, providing a feeling of a good grip while not being too bulky. The liquid carton board is a 295 gsm New Natura□ 2PE i.e., without any aluminum foil commercialized by Stora Enso with about 87% fiber content. The board is hot welded to the base and includes skiving. The upper edge was protected with a thin polymeric strip. The board web was textured before die cutting. The board was also creased after die cutting as shown in FIG. 7*b*. The molded base is in HDPE and includes a small silicone valve 50 to promote dispensing. The valve 50 is sandwiched between the molded base 20 and a plastic roundel 51 as shown per FIG. 4. The valve 50 is sealed externally by means of a removable film sticker (not shown) to prevent accidental dispensing during distribution and storage. The total fiber content of this bottle is above 70%. The bottle was found leak and pinhole free. The bottle was also found to be water resistant as per the test methods disclosed herein. The side wall vapor transmission rate was measured to be below 20 g/sqm/day at 25 C 60% RH. For a 10 mm deflection in the squeeze test, the average dose dispensed was found to be 9 g for a force of 31 N using the identical product of Example 1. Also, the bottle did not permanently indent or deform when squeezed with a 10 mm deflection. While the slit valve 50 is expected to increase the squeezing force required during dispensing, it was found that the bottle of Example 2 was easier to squeeze than the bottle of Example 1 as well as enable consumers to get the intended dosage of 5-10 g without requiring multiple squeezes. The bottle was also sortable as liquid carton based on NIR testing as well as passing the minimum level for the PTS-RH 021/97 cat 2 test with a fiber recovery of at least 50%.

What is claimed is:

1. A squeezable fiber-based bottle for storing and dispensing a viscous liquid, the bottle comprising:

a molded base including a liquid containing surface having an aperture for dispensing viscous liquid, the molded base having a base perimeter with a perimeter surface including an upper edge and a lower edge, and a fiber-based side wall having an upper edge, a lower edge, an outer surface, an inner surface, a front panel, a back panel and two opposing side panels, the inner surface including a fiber-based side wall barrier layer, wherein one of the two opposing side panels includes crease lines forming a flat portion and wherein the lower edge of the fiber-based side wall is affixed about the entire perimeter surface of the molded base forming an impermeable seal wherein the lower edge of the fiber-based side wall is disposed near the perimeter surface upper edge but not the perimeter surface lower edge, the molded base perimeter surface lower edge is below the liquid containing surface allowing the squeezable fiber-based bottle to stand vertically.

2. The squeezable fiber-based bottle according to claim 1 wherein the two opposing side panels include crease lines forming flat portions in the opposing side panels.

3. The squeezable fiber-based bottle according to claim 2 wherein the molded base has a front surface, a back surface, a major axis, a minor axis and a width along the minor axis, wherein the flat portions on the two opposing side panels have a length, wherein the width of the molded base along the minor axis exceeds the length of the flat portions by at least 10 mm.

4. The squeezable fiber-based bottle according to claim 2 wherein the opposing side panels have a length extending from the lower edge to the upper edge and wherein the crease lines extend from the lower edge toward the upper edge less than the length of the opposing side panels.

5. The squeezable fiber-based bottle according to claim 1 wherein the molded base has a major axis and a minor axis and wherein the upper edge of the fiber-based side wall has a length that is less than or equal to the length of the major axis.

6. The squeezable fiber-based bottle according to claim 5 wherein the side wall includes a texture formed by creasing the side wall.

7. The squeezable fiber-based bottle according to claim 1 wherein fiber-based side wall has a WVTR of less than 20 g/sqm/day at 25° C., 60% relative humidity.

8. The squeezable fiber-based bottle according to claim 1 wherein fiber-based side wall is a liquid packaging board formed from a blank.

9. The squeezable fiber-based bottle according to claim 8, wherein the blank includes side edges that are not parallel.

10. The squeezable fiber-based bottle according to claim 8 wherein the blank includes creases forming flat portions in the side panels.

11. The squeezable fiber-based bottle according to claim 1 wherein the squeezable fiber-based bottle comprises a fiber content of at least 50%.

12. The squeezable fiber-based bottle according to claim 1 wherein the squeezable fiber-based bottle is sortable and recyclable in a liquid carton board stream.

13. The squeezable fiber-based bottle according to claim 1 wherein the aperture for dispensing viscous liquid includes a slit valve.

14. The squeezable fiber-based bottle of claim 1 wherein the lower edge of the fiber-based side wall is affixed about the entire perimeter surface of the molded base near the perimeter surface upper edge and separated from the perimeter surface lower edge by at least 1 mm.

15. The squeezable fiber-based bottle according to claim 1 wherein the molded base has a front panel curvature and a back panel curvature, wherein the front panel curvature is different than the back panel curvature.

16. The squeezable fiber-based bottle according to claim 1 wherein the side wall includes perforations which can be torn to access an interior of the container.

17. The squeezable fiber-based bottle according to claim 16 wherein the perforations are located below the upper edge, and wherein the upper edge is folded to cover the perforations.

18. The squeezable fiber-based bottle of claim 1 wherein the squeezable fiber-based bottle is crushable into a flat configuration providing at least 90% product evacuation.

19. The squeezable fiber-based bottle of claim 1, wherein the squeezable fiber-based bottle maintains structural integrity and performance when used in a wet environment.

20. The squeezable fiber-based bottle of claim 1, further including the viscous liquid wherein the viscous liquid has a viscosity from 5,000 to 20,000 cps $10^{-1}$ seconds.

21. A method of forming a squeezable bottle, the method comprising the steps of:

a. cutting a piece of planar elongated blank from a liquid packaging board, the blank having a first side edge, a second side edge, a lower edge and an upper edge;

b. creasing the blank to form crease lines near the first side edge and the second side edge, extending from the lower edge towards the upper edge;

c. folding the blank around a fixture to form a side wall of a squeezable bottle having a monolithic bottle shape with the upper edge and the lower edge forming open ends, a front panel, a back panel and opposing side panels wherein the opposing side panels include the crease lines forming flat portions in the opposing side panels;

d. overlapping the two side edges of the blank, and applying heat-sealing energy and pressure to the side edges forming a longitudinal hermetically sealed seam;

e. providing a molded base having a base perimeter with a perimeter surface including an upper edge and a lower edge;

f. removing the side wall from the fixture and sealing the lower edge of the side wall to the molded base near the perimeter surface upper edge but not the perimeter surface lower edge creating an impermeable seal; and g. filling the bottle with content and sealing the upper edge.

* * * * *